US005406366A

United States Patent [19]

Kusumoto et al.

[11] Patent Number: 5,406,366

[45] Date of Patent: Apr. 11, 1995

[54] COLOR COPYING MACHINE AND A METHOD OF FORMING A MULTICOLORED IMAGE

[75] Inventors: Keiji Kusumoto; Kenichi Muroki, both of Toyokawa, Japan

[73] Assignee: Minolta Camera Kabushiki Kaisha, Osaka, Japan

[21] Appl. No.: 695,398

[22] Filed: May 3, 1991

[30] Foreign Application Priority Data

May 7, 1990 [JP] Japan ..... 2-117909
May 7, 1990 [JP] Japan ..... 2-117910
May 7, 1990 [JP] Japan ..... 2-117911
May 7, 1990 [JP] Japan ..... 2-117912

[51] Int. Cl.[6] ..... G03G 15/01

[52] U.S. Cl. ..... 355/327; 355/246

[58] Field of Search ..... 355/326, 327, 208, 328, 355/245, 246

[56] References Cited

U.S. PATENT DOCUMENTS 4,204,728 5/1980 Goshima et al. ..... 118/645 X
4,623,917 11/1986 Noguchi ..... 358/80
4,655,579 4/1987 Adachi et al. ..... 355/218
4,910,557 3/1990 Imai ..... 355/208 X
4,933,721 6/1990 Yasuda et al. ..... 355/210
4,947,210 8/1990 Nagata et al. ..... 355/218
5,023,632 6/1991 Yamamoto et al. ..... 355/326 X
5,028,960 7/1991 Yasuda et al. ..... 355/208 X
5,032,904 7/1991 Murai et al. ..... 355/327 X
5,089,859 2/1992 Kusumoto et al. ..... 355/327
5,136,372 8/1992 Nakatani et al. ..... 355/326 X
5,160,969 11/1992 Mizuma et al. ..... 355/326

FOREIGN PATENT DOCUMENTS 61-13262 1/1986 Japan .

*Primary Examiner*—Leo P. Picard
*Assistant Examiner*—Christopher Horgan
*Attorney, Agent, or Firm*—Burns, Doane, Swecker & Mathis

[57] ABSTRACT

Disclosed is a copying machine for forming a multicolored image, having a plurality of developing devices which contain toner of different colors, and a color image sensor for reading an original image. The copying machine judges each part of the original image whether to be a monochromatic area or a color area, from image data collected by the color image sensor. Then, the copying machine reproduces the monochromatic area by use of only one of the developing devices which contains black toner, and reproduces the color area by use of more than one of the developing devices which contain other color toner. Further, the copying machine detects a border area between the monochromatic area and the color area, and reproduces the border area by use of all the developing devices.

22 Claims, 25 Drawing Sheets

EXPOSURE
ERASURE
DEVELOPMENT
TRANSFERENCE
FIRST FORMATION
B FILTER
SECOND FORMATION
G FILTER
THIRD FORMATION
R FILTER
FOURTH FORMATION
ND FILTER
a1
a2
a3
a4
b1
b2
b3
b4
c1
c2
c3
c4
d1
d2
d3
d4
e
3
15
ZCb
ZMb
ZCg
ZMg
ZCr
ZMr
ZCn
ZMn
TCy
TCm
TCc
TMk
Tymc
Y
M
C
BK
ONTO PAPER
P
FG
EC
EM

100 : IMAGE PROCESSING SECTION

COLOR COPYING MACHINE AND A METHOD OF FORMING A MULTICOLORED IMAGE

BACKGROUND OF THE INVENTION

1. Field of the Invention

The present invention relates to a color copying machine comprising a plurality of developing devices which contain toner of different colors, and to a method of forming a multicolored image.

2. Description of Related Art

In color copying adopting the electrophotographic processing, generally toner of three primary colors (yellow, magenta and cyan) is used, and a multicolored image including black is formed by combining toner images of these colors.

Poor combination of the toner images results in a rough, low degree of copy image.

In order to improve the quality of the copy image, U.S. Pat. No. 4,655,579 disclosed a color copying machine comprising four developing devices which contain yellow, magenta, cyan and black toner, an image sensor for reading an original image by resolving the original image into elements, and an eraser for partly erasing an electrostatic latent image on a photosensitive member. Each element of the original image is judged whether to be black, from image data collected by the image sensor. Then, in processes of forming toner images of the three primary colors, parts of the electrostatic latent image corresponding to image elements judged to be black are erased so that toner will not stick to the parts, and in a process of forming a black toner image, parts of the electrostatic latent image corresponding to image elements judged not to be black are erased.

In short, black parts of the original image are reproduced with black toner, and the other parts are reproduced by combining the three primary colors of toner.

The eraser consists of a large number of LEDs which are turned on selectively, and areas which are irradiated by two adjacent LEDs overlap so that the entire surface of the photosensitive member will have the same quantity of light from the LEDs.

When an original image composed of a color part such as a color picture, and a monochromatic part such as letters is copied by use of such a copying machine, the copy image is fine, and small letters and drawings are clear.

In this specification, "monochromatic" and "color" are not recognized merely by the eye but are recognized based on the significance of letters and patterns as information. A part composed of a field color (usually white) and a specified color (usually black) is referred as a monochromatic part, and a part including any other color is referred as a color part.

Conventionally, every black part is reproduced with black toner whether it is in a monochromatic part or in a color part, and some parts fail to be reproduced. For example, when copying a color picture wherein a black part is bordering a color part, the border area may be missing on a copy. In the processes of forming toner images of the three primary colors, a part of the electrostatic latent image corresponding to the black part is erased, and in the process of forming a black toner image, a part of the electrostatic latent image corresponding to the color part is erased. However, because parts which are irradiated by two adjacent LEDs of the eraser overlap, the overlapping portion is erased both in the process of forming toner images of the three primary colors and in the process of forming a black toner image. As a result, the overlapping portion, that is, the border area between the black part and the color part is missing on a copy.

Also, due to errors of resolution of the image sensor and errors in judging the color of an image, there have been the following problems. A color part may be reproduced in black, and blurs may occur. Black in several tones of a color part may be reproduced in uniform black. A gradation of colors around a border between a color part and a black part cannot be reproduced well.

Thus, the reproductivity of a color part is low, and a thus made copy is not identical with the original.

SUMMARY OF THE INVENTION

An object of the present invention is to provide an image forming apparatus and an image forming method wherein colors are reproduced well without occurring uncoloring and blurs and a fine multicolored copy can be obtained.

Another object of the present invention is to provide an image forming apparatus and an image forming method wherein an original image is divided into a color part and a monochromatic part accurately and a multicolored copy which has no uncoloring and blurs and which has continuity of the color part and the monochromatic part can be obtained.

In order to attain the objects, an image forming apparatus according to the present invention comprises a color image sensor, a plurality of developing means, control means of the developing means and area judging means. The color image sensor reads an original image and outputs image signals indicating the density and color of the image. The developing means contain developers of different colors, and one of the developing means contains a black developer. The area judging means judges each part of the original image whether to be a monochromatic area composed of black and white or to be a color area including any other color, from the image signals sent from the color image sensor. The control means drives the plurality of developing means selectively in accordance with output of the area judging means so that a black part of the monochromatic area is developed by only the black developing means and that a black part of the color area is developed by the other developing means.

In the image forming apparatus, preferably, a part of the original image is judged whether to be a monochromatic area or to be a color area, from the image signals regarding the part and its periphery.

Further, the image forming apparatus comprises means for judging a border area between the monochromatic area and the color area. The control means controls the plurality of developing means so that a black part of the border area is developed by more than one of the developing means including the black developing means.

Another image forming apparatus according to the present invention comprises a color image sensor, color data outputting means, a plurality of developing means, control means of the developing means and area judging means. The color data outputting means makes color data regarding each unit of an original image from output of the color image sensor. The area judging means judges each unit whether to be a monochromatic area or to be a color area, from the color data regarding the unit and its peripheral units in a specified size of block. The control means controls the plurality of developing means so that a black part of the monochromatic area is developed by only the black developing means, that a black part of the color area is developed by the other developing means and that a black part of the border area is developed by more than one of the developing means including the black developing means.

In the image forming apparatus, a unit is judged to be a color area when all the color data regarding the units in the block indicate black and the density of the block is light.

An image forming method according to the present invention comprises the steps of: reading an original image with a color image sensor; judging the color of each part of the original image, from output of the color image sensor; dividing the original image into a monochromatic area and a color area in accordance with output at the color judging step; forming an electrostatic latent image corresponding to the original image on a photosensitive member; erasing a part of the electrostatic latent image corresponding to a black part of the monochromatic area so as to form a first electrostatic latent image; developing the first electrostatic latent image with developing means which contains a color developer other than black; forming an electrostatic latent image corresponding to the original image on the photosensitive member again; erasing parts of the electrostatic latent image corresponding to the color area and a non-black part of the monochromatic area so as to form a second electrostatic latent image; and developing the second electrostatic latent image with the developing means which contains a black developer.

In the image forming apparatus and the image forming method, uncoloring and blurs can be prevented, and a fine multicolored copy which has continuity of a monochromatic area and a color area can be obtained. Also, an original image can be divided into a color area and a monochromatic area accurately.

BRIEF DESCRIPTION OF THE DRAWINGS

These and other objects and features of the present invention will become apparent from the following description taken in conjunction with the preferred embodiments thereof with reference to the accompanying drawings, in which:

FIG. 1 is a schematic view showing a color copying machine;

FIG. 2 is an explanatory view showing an edit eraser;

FIG. 3 is a block diagram showing a control circuit;

FIG. 4 is a plan view showing an operation panel of the copying machine;

FIG. 5 is an explanatory view showing original image reading;

FIG. 6 is an explanatory view showing a procedure of color copying schematically;

Figure 8:
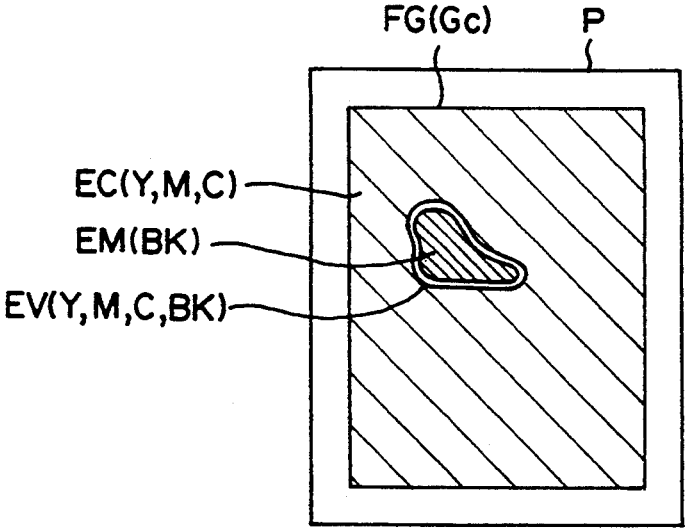
Figure 9:
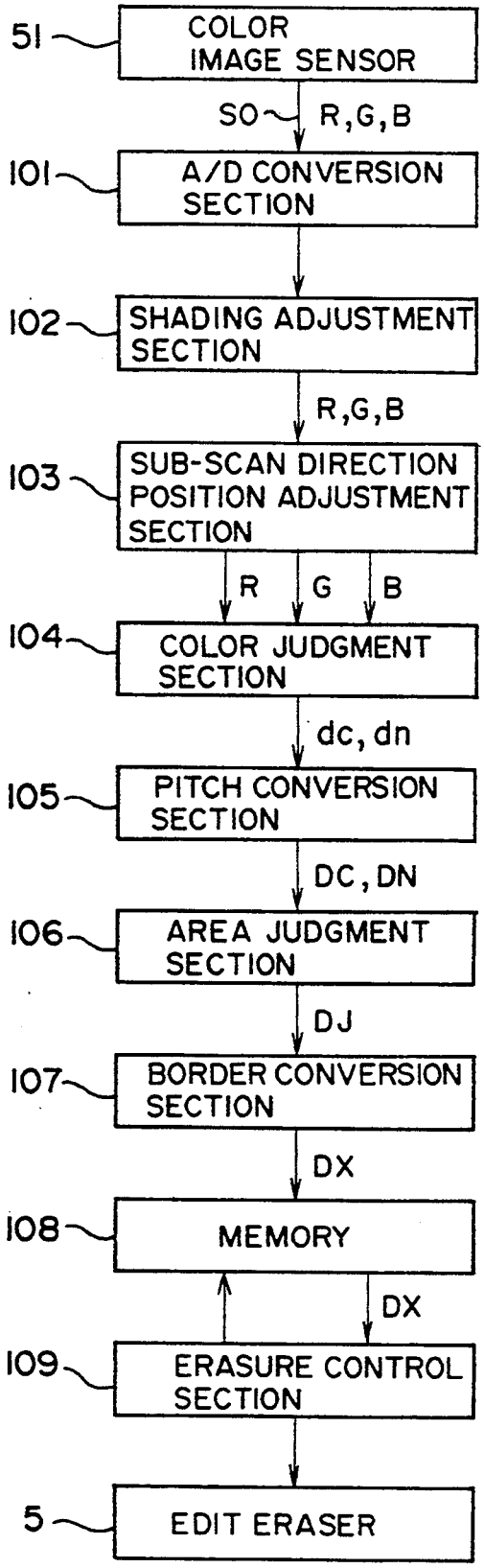
Figure 10:
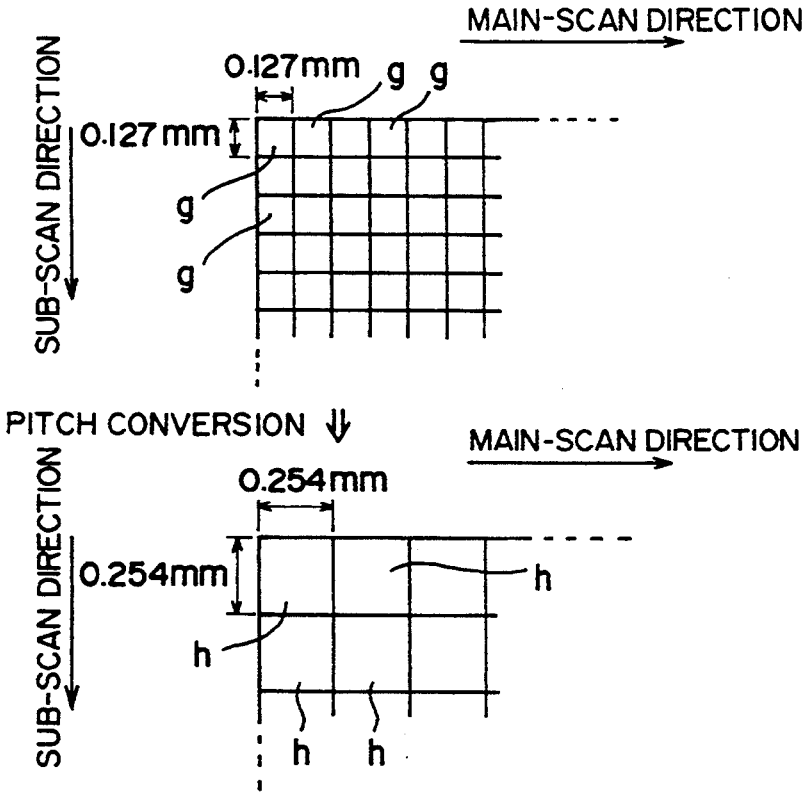
Figure 11:
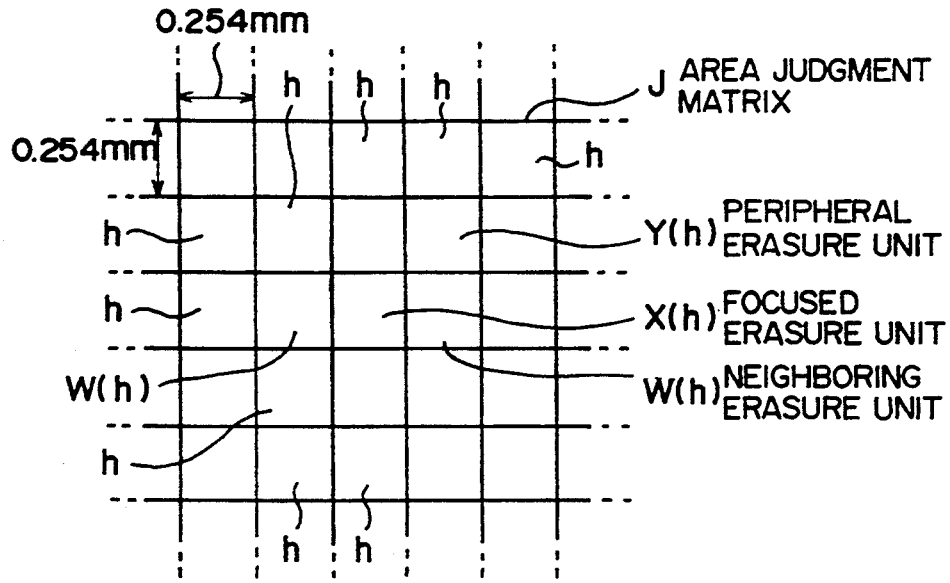
Figure 13:
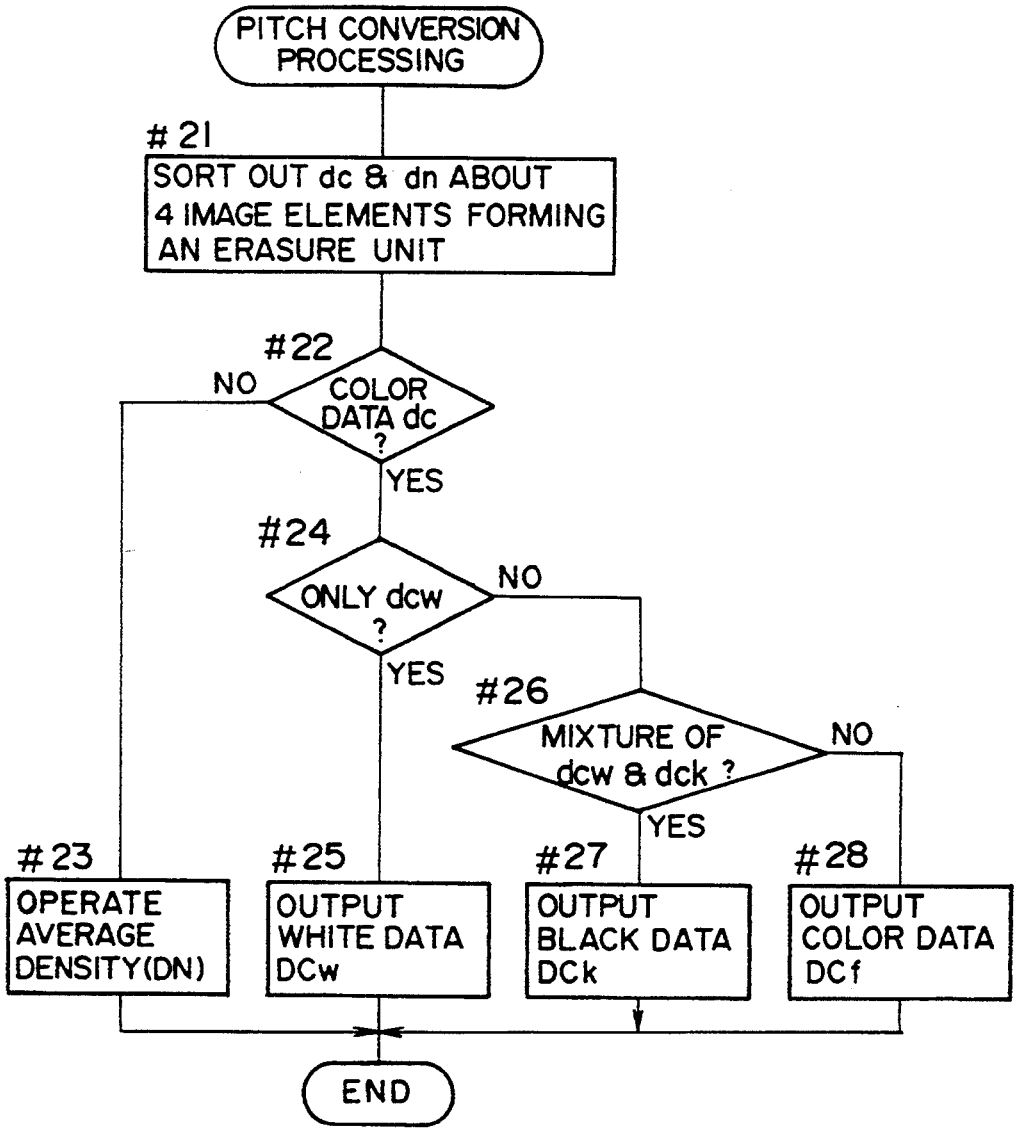
Figure 14:
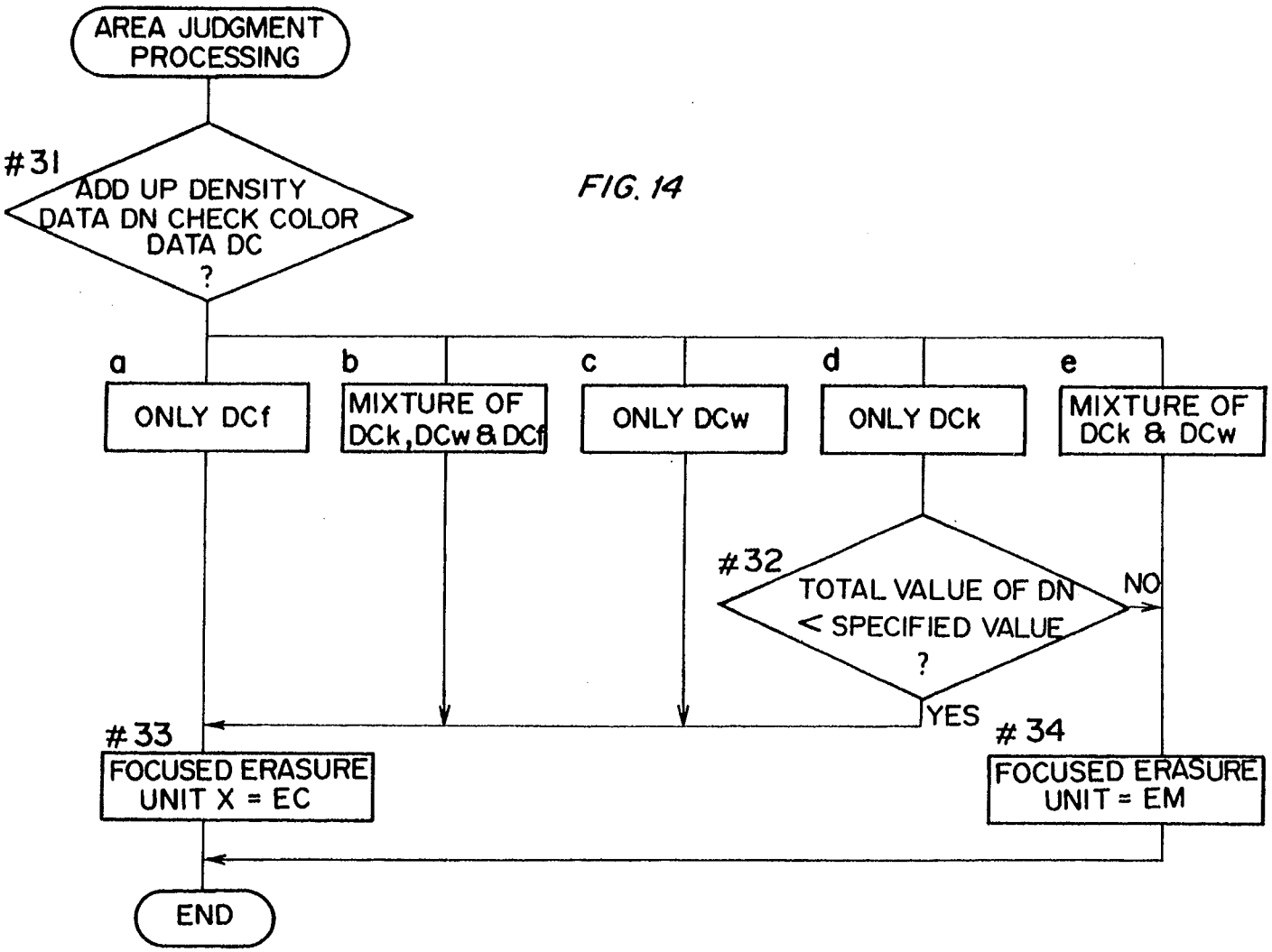
Figure 15:
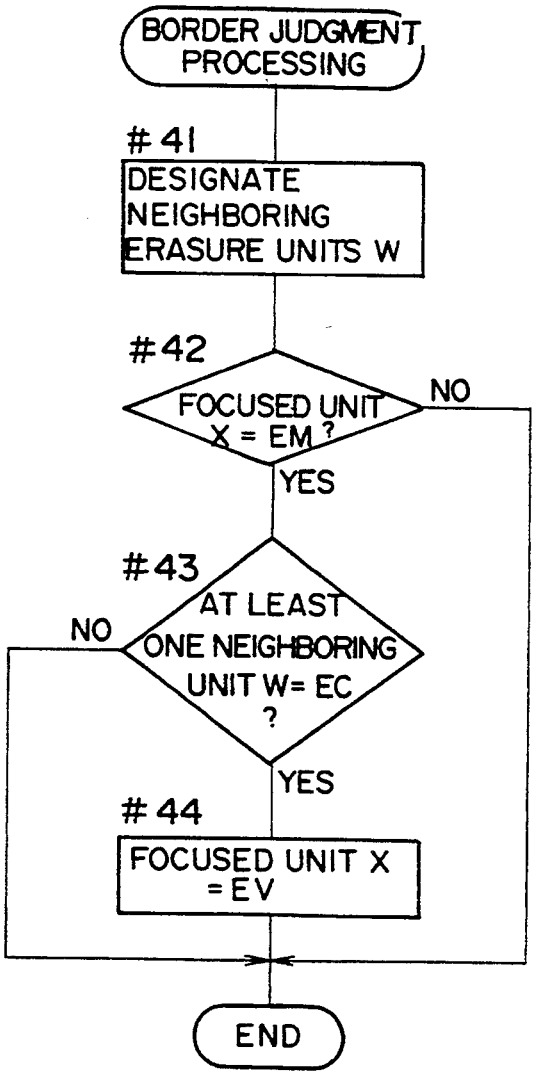
Figure 17:
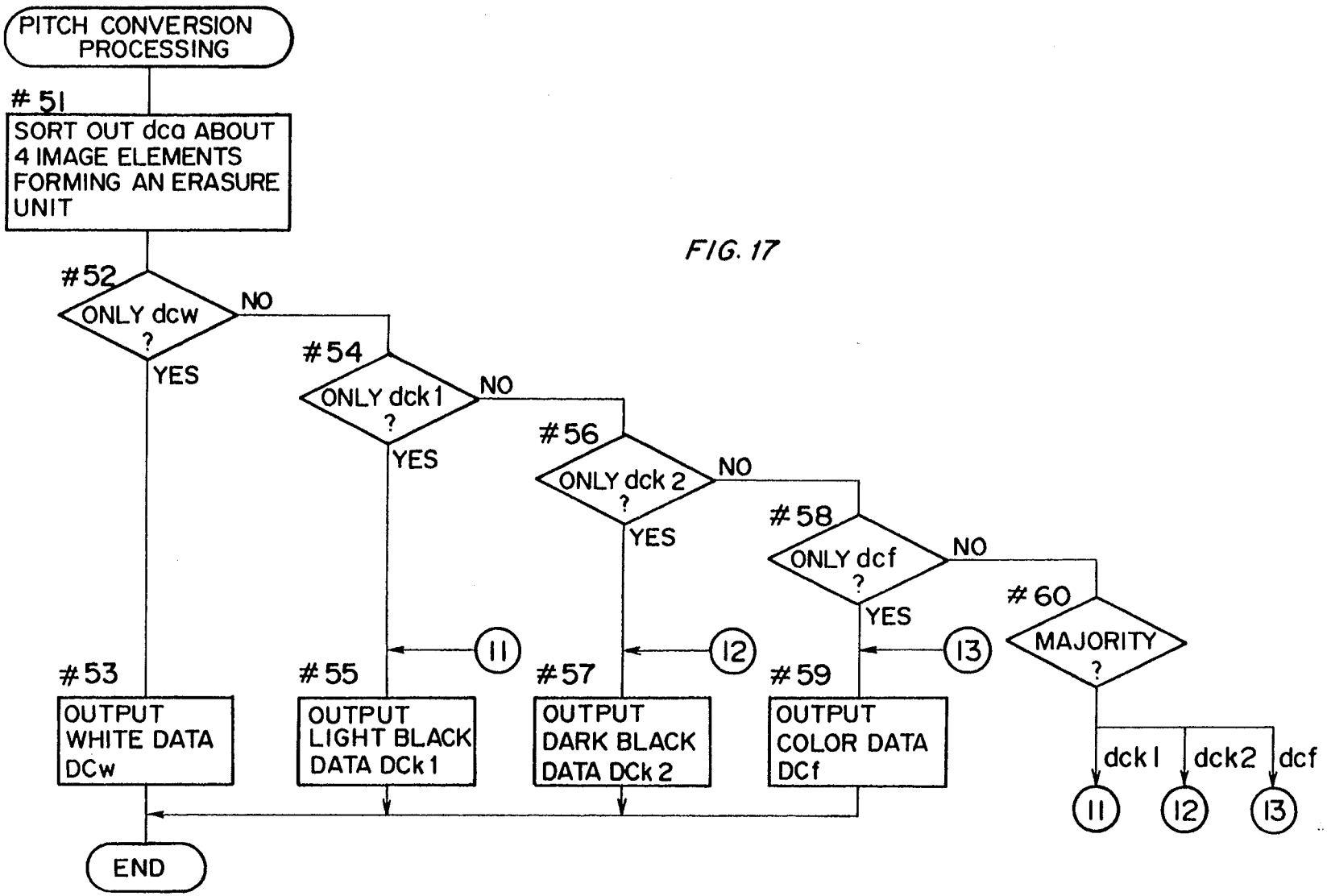
Figure 18:
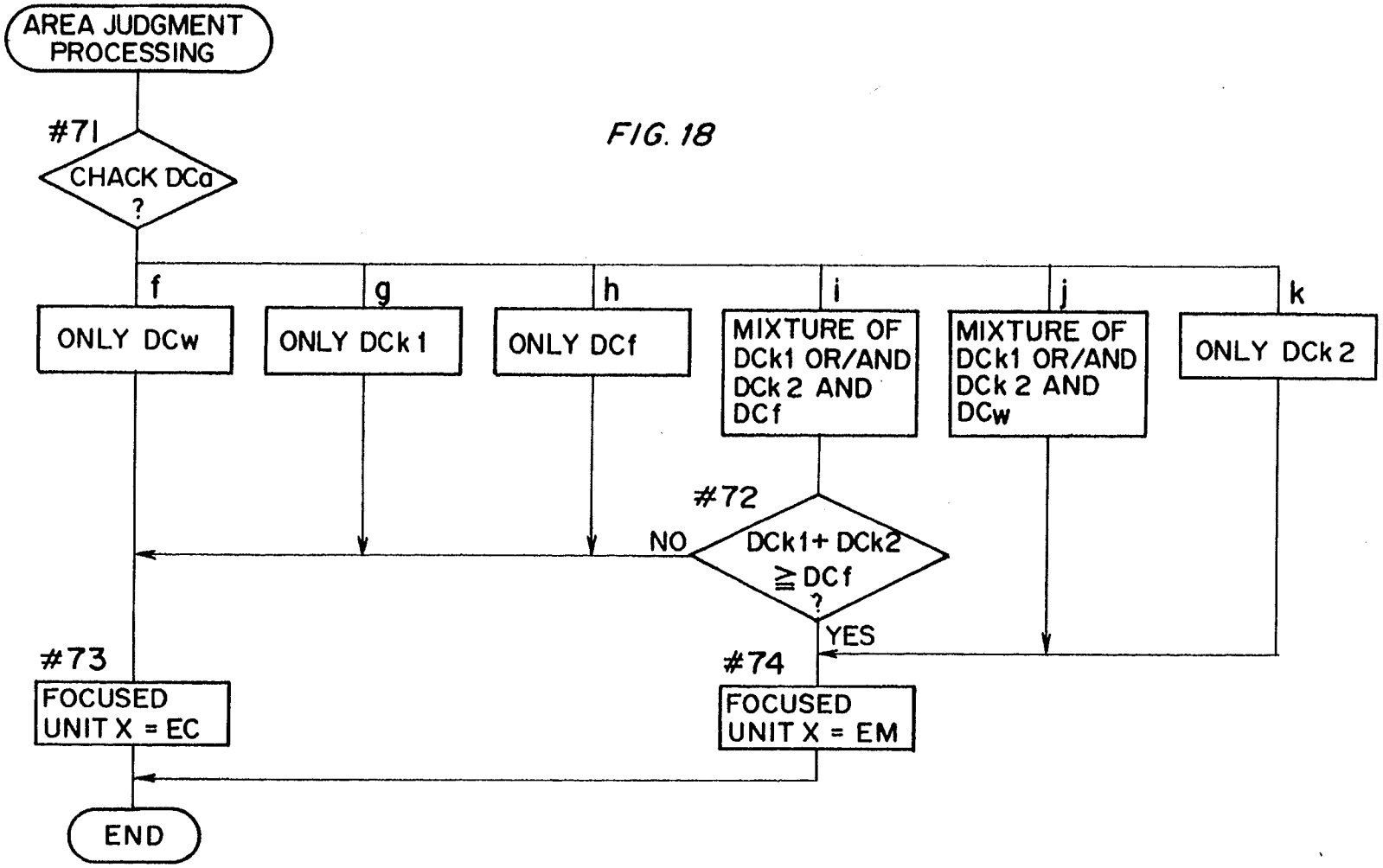
Figure 19:
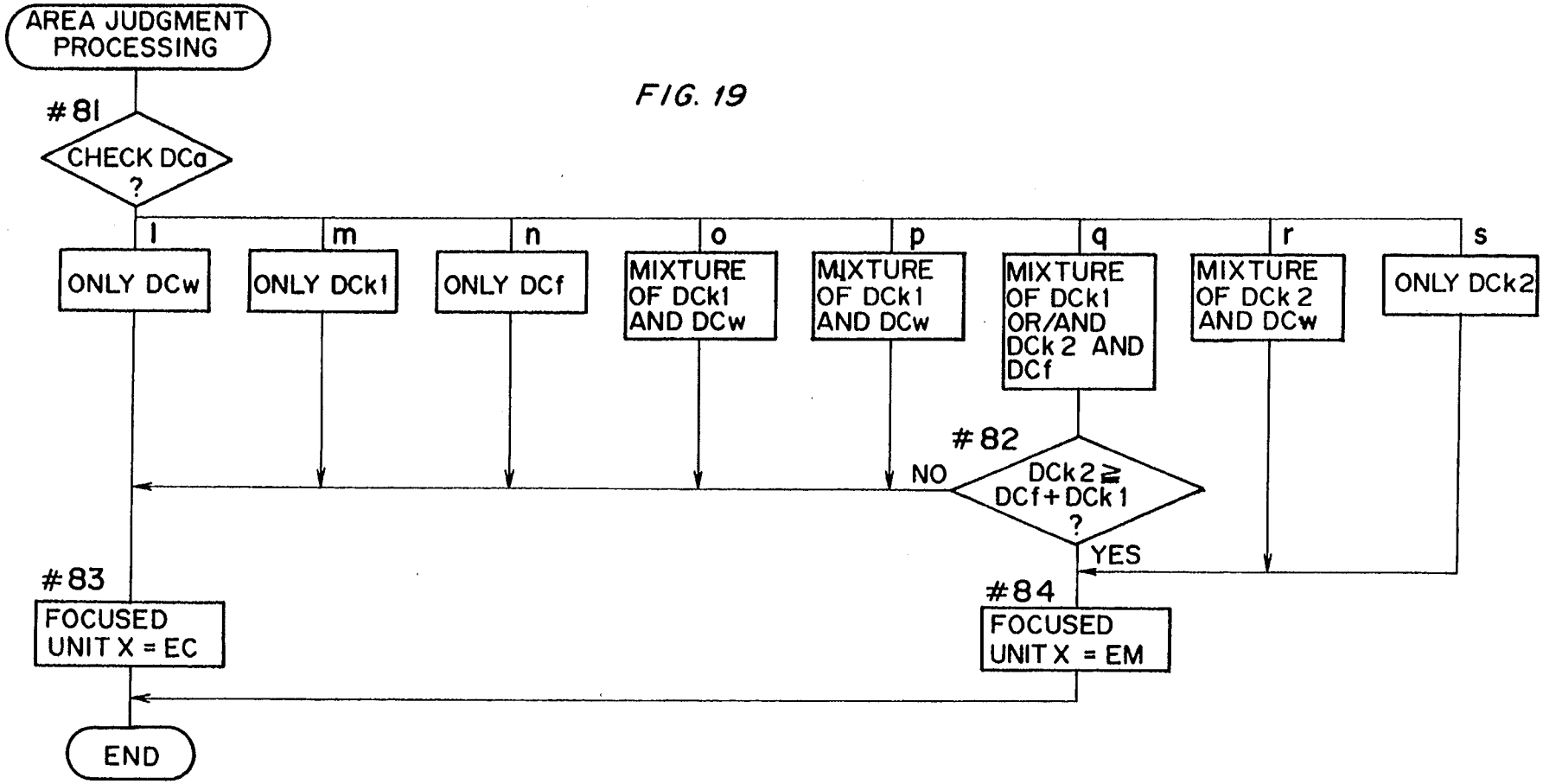
Figure 20:
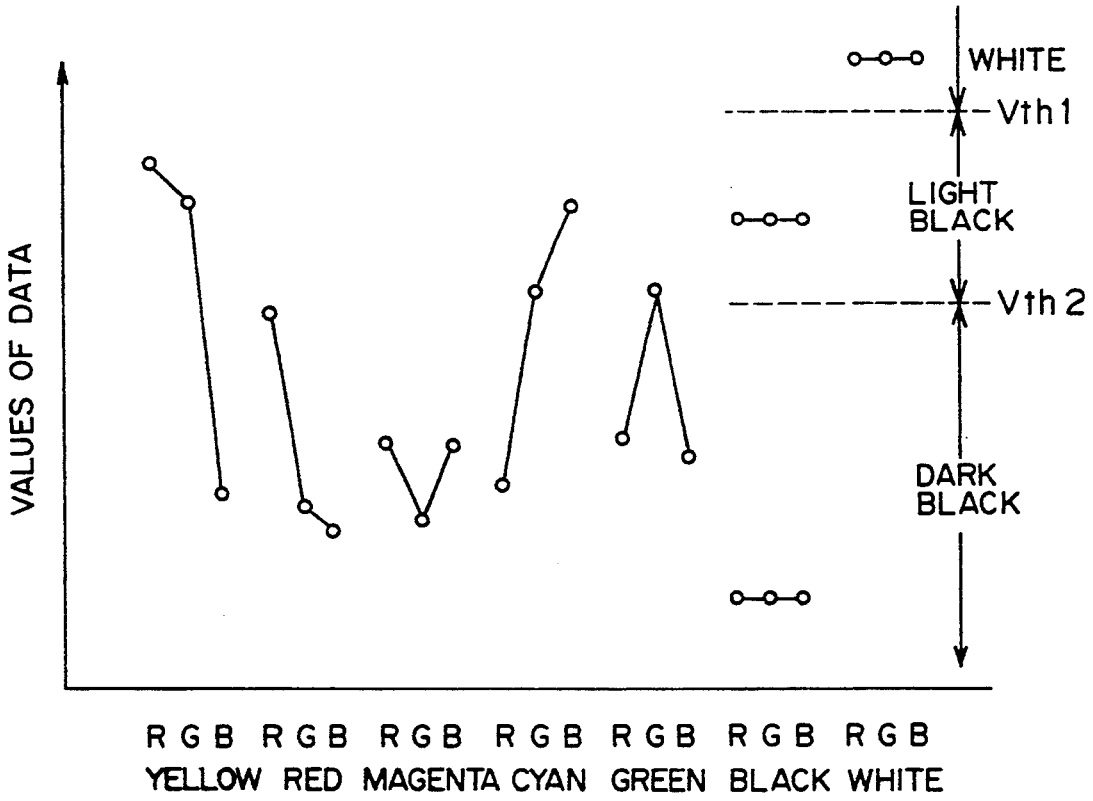

FIG. *7a* is an explanatory view showing original image reading for a color copying process;

FIG. *7b* is an explanatory view showing an image formation on a photosensitive drum for color copying;

FIG. 8 is a model of a copy image;

FIG. 9 is a block diagram showing the constitution of an image processing section;

FIG. 10 is an explanatory view showing the relationship between image elements and erasure units;

FIG. 11 is an explanatory view showing an area judgment matrix;

FIGS. 12*a*, 12*b*, 12*c*, 12*d* and 12*e* are block diagrams showing a circuit of the image processing section;

FIG. 13 is a flowchart showing pitch conversion processing performed by a pitch conversion section;

FIG. 14 is a flowchart showing area judgment processing performed by an area judgment section;

FIG. 15 is a flowchart showing border judgment processing performed by a border conversion section;

FIGS. 16*a* through 16*d* and 20 show a second embodiment of the present invention;

FIGS. 16*a*, 16*b*, 16*c* and 16*d* are block diagrams showing a circuit of an image processing section;

FIG. 17 is a flowchart showing pitch conversion processing performed by a pitch conversion section;

FIG. 18 is a flowchart showing area judgment processing performed by an area judgment section;

FIG. 19 is a flowchart showing border judgment processing performed by a border conversion section; and FIG. 20 is a chart showing color judgment performed by color judgment section.

DETAILED DESCRIPTION OF THE PREFERRED EMBODIMENTS

The following describes image forming apparatuses and methods of forming a multicolored image according to the present invention referring to the accompanying drawings. In the following embodiments, the present invention is adapted to electrophotographic machines.

FIGS. 1 through 15 show a first embodiment of the present invention.

Figure 1:
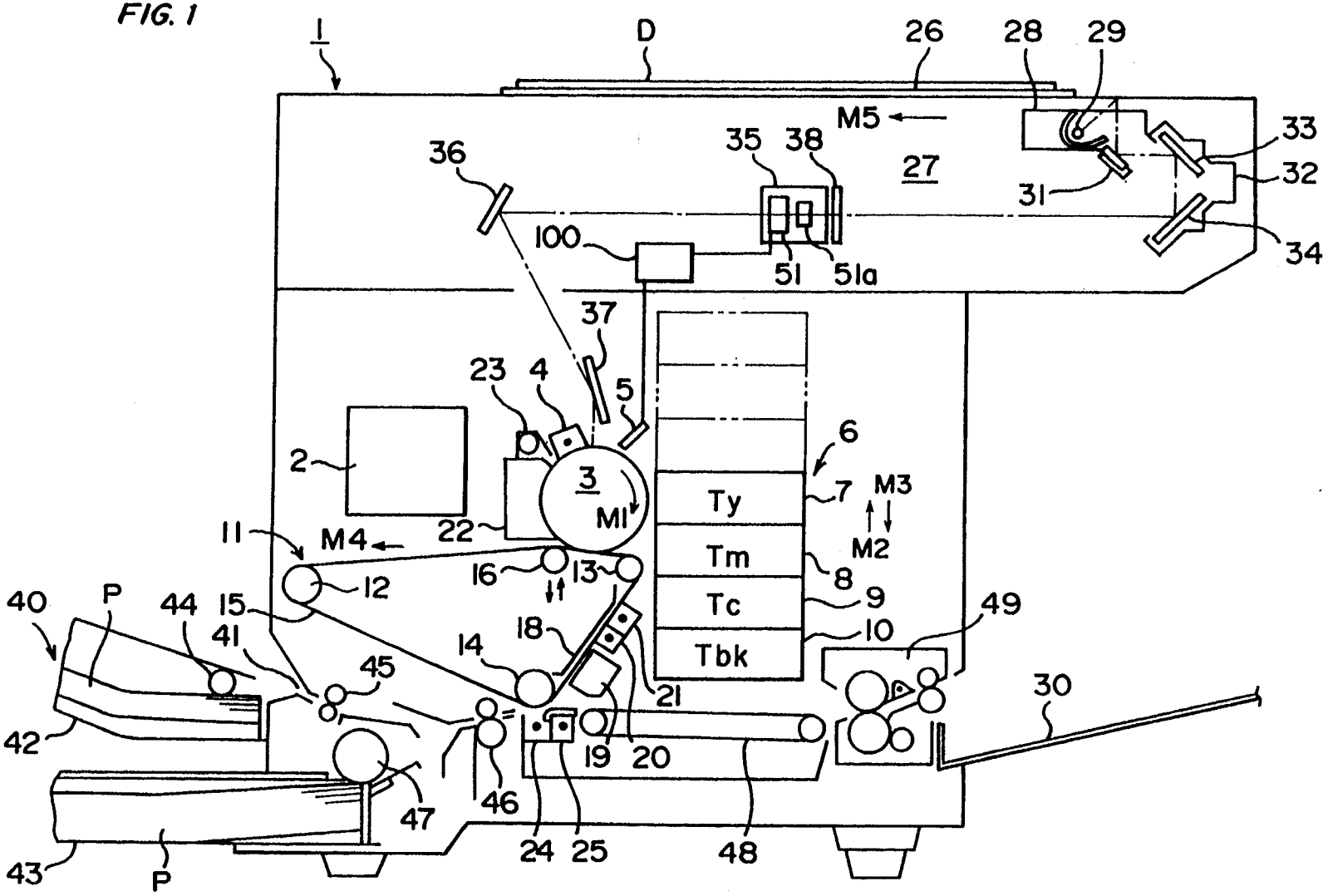
FIGS. 1 through 15 show a first embodiment of the present invention.
Figure 2:
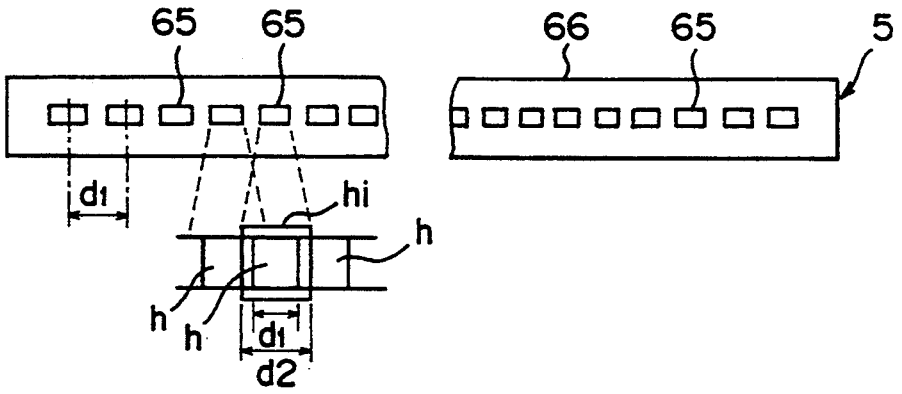

FIG. 1 shows the schematic constitution of a copying machine 1, and FIG. 2 shows an edit eraser 5.

Approximately in the center of the copying machine 1, a photosensitive drum 3 having a photosensitive layer on the surface is rotatably disposed. Around the photosensitive drum 3, there are disposed an electric charger 4, the edit eraser 5, a developing unit 6, a transferring device 11, a cleaning device 22 and a main eraser 23.

The edit eraser 5, as shown in FIG. 2, consists of LEDs 65 arrayed on a holder 66. The LEDs 65 face the photosensitive drum 3, and they are arrayed in parallel with the axis of the photosensitive drum 3 at intervals of d1 (d1=0,254 mm), which is an erasure pitch in respect to a main-scan direction. The LEDs 65 are separately controlled to be turned on and off. An erasure pitch in respect to a sub-scan direction, which depends on the rotating speed of the photosensitive drum 3 and the time each of the LEDs 65 is controlled to be turned on and off, is set to 0.254 mm in this embodiment. Accordingly, the area of an erasure unit h of the photosensitive drum surface 3 is 0.254 mm×0.254 mm. An irradiation unit hi of the photosensitive drum surface 3 which is irradiated by each of the LEDs 65 is slightly larger than the erasure unit h (d2>d1). That is, the irradiation units hi overlap. This compensates errors of the LEDs 65 in directivity and prevents uneven irradiation of an erasure unit h, so that the amount of light on the peripheral portion of the erasure unit h is approximately the same as that on the center portion, which results in even erasure.

The developing unit 6 comprises four developing devices 7, 8, 9 and 10, and they together move up and down as indicated by the arrows M2 and M3 so that any one of the developing devices 7, 8, 9 and 10 can supply toner to the photosensitive drum 3. The developing devices 7, 8, 9 and 10 contain yellow toner Ty, magenta toner Tm, cyan toner Tc and black toner Tbk respectively. The developing unit 6 is not limited to the vertically moving type. The developing unit 6 should be so made that it can supply toner of different colors to the photosensitive drum 3.

The transferring device 11 transfers toner from the photosensitive drum 3 onto a transfer belt (transferring medium) 15. The transfer belt 15 consists of a conductive support made of conductive polyester including carbon resin, and a dielectric layer made of polyethylene or the like on the support. The transfer belt 15 is endlessly wound around rollers 12, 13 and 14 which are disposed in parallel with the photosensitive drum 3.

Inside the round of the transfer belt 15, a pressing roller 16 is disposed between the rollers 12 and 13. The rollers 12, 13, 14 and 16 rotate at the same peripheral speed as the photosensitive drum 3, and the transfer belt 15 contacts with and separates from the photosensitive drum 3 with upward and downward movements of the pressing roller 16. A guide plate 18 is disposed between the rollers 13 and 14 along the transfer belt 15, and outside of the round of the transfer belt 15, opposite the guide plate 18, there are disposed a cleaning device 19, an erasing charger 20 and an electric charger 21. Further, a secondary transfer charger 24 is disposed under the roller 14, outside of the round of the transfer belt 15, and a separation charger 25 is disposed next to the secondary transfer charger 24.

An optical system 27 for exposing the surface of the photosensitive drum 3 is arranged in the upper part of the copying machine 1. The optical system 27 moves under an original supporting glass 26 in the direction of M5 (sub-scan direction) so as to scan an original document D on the original supporting glass 26. The optical system 27 comprises a first slider 28 having an exposure lamp 29 and a mirror 31, a second slider having mirrors 33 and 34, a filter section 38, a main lens 35, and fixed mirrors 36 and 37. The first slider 28 moves at a speed of v/n (v: peripheral speed of the photosensitive drum 3, n: magnification ratio), and the second slider 32 moves at a speed of v/2n. The filter section 38 comprises a B (blue) spectral filter, a G (green) spectral filter, an R (red) spectral filter and an ND filter which has a constant light transmitting characteristic in any visible radiation. One of the four filters is set in the light path for exposure, depending on which color of toner, yellow, magenta, cyan or black, is to be used.

Near the main lens 35, there are disposed a color image sensor 51 for detecting the color of every image element resolved from an original image, and a lens 51*a* for imaging the original on the color image sensor 51.

The color image sensor 51 consists of three arrays of light sensing elements, each of the arrays extending in the main-scan direction. The light sensing elements in the first array are provided with R (red) filters, those in the second array are provided with G (green) filters, and those in the third array are provided with B (blue) filters. One light sensing element detects one image element of the original image and generates a photoelectric transfer signal representing the strength of the reflected light of the image element. In the following description, signals and data outputted from the light sensing elements provided with the R filters are referred as R data, and likewise signals and data outputted from the light sensing elements provided with the G filters and the B filters are referred as G data and B data respectively.

An image element pitch in the main-scan direction, which depends on the intervals of the light sensing elements of the color image sensor 51, is 0.127 mm. An image element pitch in the sub-scan direction, which depends on the speed of the optical system 27, is set to 0.127 mm in this embodiment. Accordingly, the area of an image element is 0.127 mm×0.127 mm, which is a quarter of the area of an erasure unit h (see FIG. 10).

A paper feeding section 40 for feeding paper P which will receive a copy image is disposed in the left lower part of the copying machine 1, and a paper tray 30 for receiving the paper P which has received the copy image is disposed in the right lower part of the copying machine 1. The paper feeding section 40 consists of a manual feeding port 41 having a roller 45, an upper feeding cassette 42 having a roller 44, and a lower feeding cassette 43 having a roller 47, and the paper P is supplied from one of them sheet by sheet. The paper P fed from the paper feeding section 40 travels through a transport path passing timing rollers 46, a transport belt 48 and a fixing device 49, and ejected onto the paper tray 30.

Figure 3:
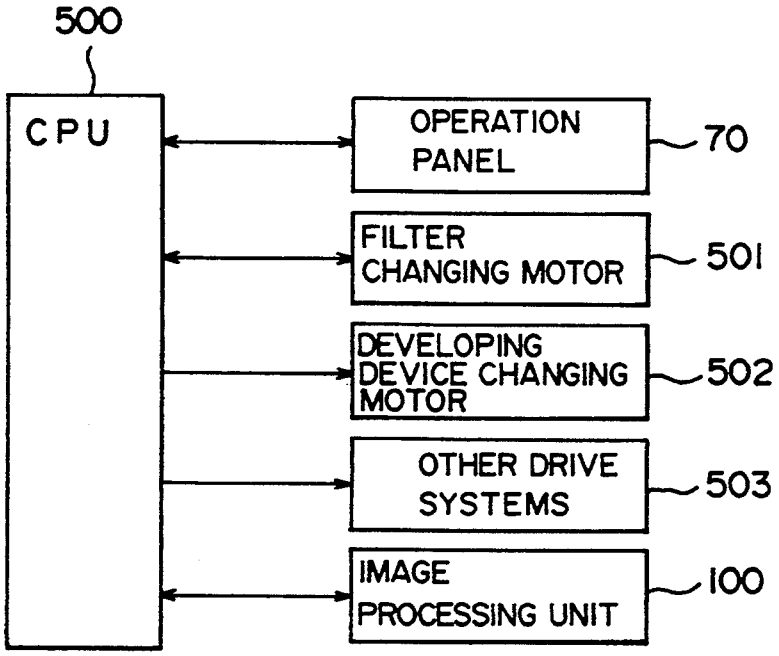

FIG. 3 shows a control circuit of the copying machine 1.

The main element of the circuit is a CPU 500, and the followings are connected with the CPU 500:

- an operation panel 70 with which an operator enters various kinds of information on copying and which indicates the entered information;
- a filter changing motor 501 for selectively setting and withdrawing the four filters of the filter section 38 into and from the light path;
- a developing device changing motor 502 for moving up and down the developing unit 6 so as to put one of the four developing devices in a position opposite the photosensitive drum 3;
- the other drive systems 503 including a main motor for driving the photosensitive drum 3 and paper transport rollers, a clutch for rotating and stopping the timing roller 46, and a scan motor for moving the optical system 27; and
- an image processing section 100 which will be described later.

A color copying operation of the copying machine 1 with the constitution above is hereinafter described.

An operator requests a copying operation in a situation where an original document D is placed on the original supporting glass 26. Then, as the photosensitive drum 3 is rotating in the direction of arrow M1 by the drive force of the main motor 2, the surface (photosensitive layer) of the photosensitive drum 3 is evenly charged by the electric charger 4 so that the surface potential will become a specified value.

Regarding the optical system 27, as the first slider 28 and the second slider 32 move in the direction of arrow M5, light radiated from the exposure lamp 29 reflects on the original document D, and the photosensitive drum 3 is exposed to the reflected light via the mirrors 31, 33 and 34, the filter section 38, the lens 35, and the mirrors 36 and 37. Thus an electrostatic latent image corresponding to the image of the original document D is formed on the photosensitive drum 3.

Next, the surface potential on the peripheral area of the electrostatic latent image is erased by the edit eraser 5. This prevents toner from sticking to unnecessary parts of the photosensitive drum 3, or this results in making a copy having a margin on the peripheral area of a sheet of paper P. Simultaneously, the edit eraser 5 erases the surface potential on certain areas except for border areas EV in accordance with area data DX, which process will be described later.

Subsequently the electrostatic latent image on the photosensitive drum 3 is developed by a predetermined developing device in the developing unit 6, and thus a toner image is formed on the photosensitive drum 3.

Meanwhile, in the transfer device 11, the pressing roller 16 is moved up as shown in FIG. 1 by the main motor 2, and the transfer belt 15 comes into contact with the photosensitive drum 3 between the pressing roller 16 and the roller 13. Then, as the transfer belt 15 is rotating in the direction of arrow M4, the transfer belt 15 is evenly charged by the electric charger 21. The speed of the transfer belt 15 is the same as the peripheral speed of the photosensitive drum 3.

When the toner image on the photosensitive drum 3 comes to the contact part with the transfer belt 15, the toner image is electrostaticly transferred onto the transfer belt 15.

Thereafter the cleaning device 22 cleans the photosensitive drum 3 so that the residual toner on the surface is removed, and the main eraser 23 erases the residual charge on the photosensitive drum 3. Thus the photosensitive drum 3 gets ready for next exposure.

The toner image transferred onto the transfer belt 15 is conveyed in the direction of arrow M4 with the movement of the belt 15.

The processes above are repeated until the transfer belt 15 receives yellow, magenta, cyan and black toner images. Thus, a multicolored toner image is formed on the transfer belt 15. Further, the transfer belt 15 has a mark which is detected by a sensor (not shown) so that the toner images of the four colors will be well positioned on the transfer belt 15.

Meanwhile, a sheet of paper P fed from the paper feeding section 40 is transported from the timing roller 46 in synchronization with the movement of the transfer belt 15, and when the sheet P comes to a place opposite the secondary charger 24, the toner image is transferred from the transfer belt 15 onto the sheet P by electric discharge from the secondary charger 24.

The sheet P which has received the toner image is separated from the transfer belt 15 by the separation charger 25, and is transported to the fixing device 49 through the conveyer belt 48. In the fixing device 49, the toner image is fused and fixed on the sheet P, and the sheet P is ejected onto the paper tray 30.

After passing the secondary charger 24, the transfer belt 15 is cleaned by the cleaning device 19 so that the residual toner on the surface is removed, and the erasure charger 20 erases the residual charge on the surface.

Figure 4:
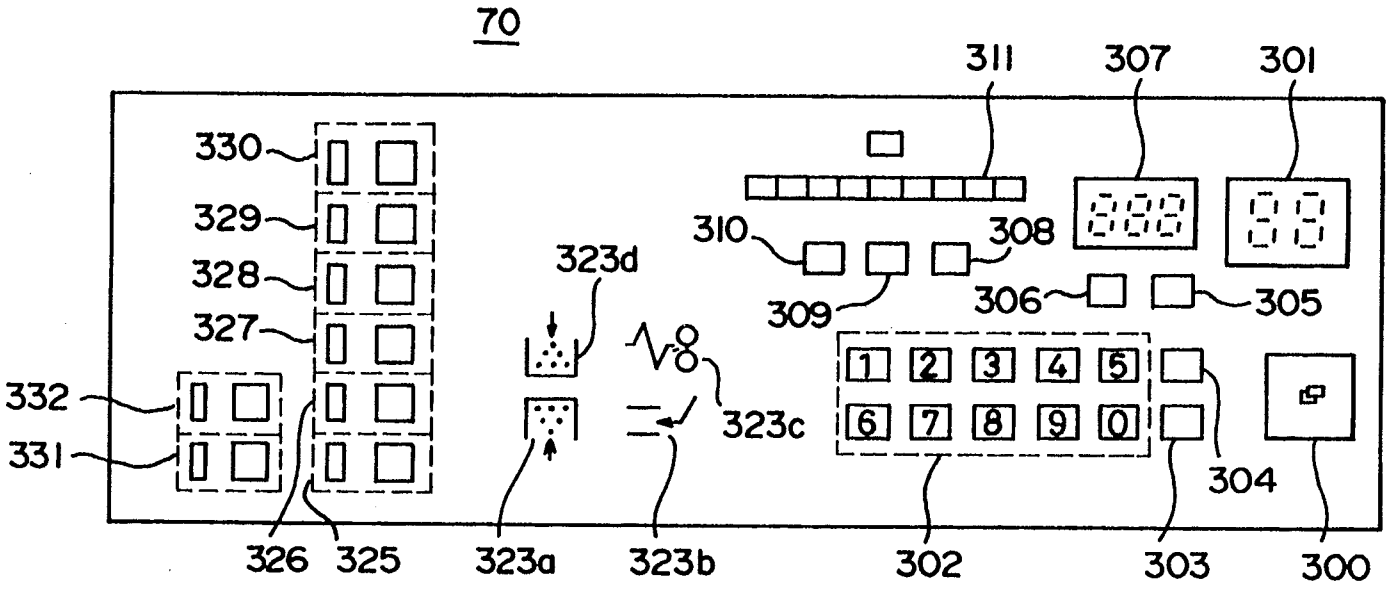

FIG. 4 shows the operation panel 70 disposed on the upper surface of the copying machine 1.

The operation panel 70 comprises a print key 300 for starting a copying operation, a seven-segment LED 301 for indicating the number of copies, a ten-key 302 for setting the number of copies to be made, a clear/stop key 303, an interruption key 304, magnification ratio setting keys 305 and 306, a seven-segment LED 307 for indicating the magnification ratio, an up key 310 and a down key 308 for altering the density, a density auto/-manual key 309 for selecting either automatic density setting or manual density setting, an LED 311 for indicating the density, color selection sections 325 through 330 which consists of keys and LEDs, and copying mode selection sections 331 and 332.

FIGS. 5 through 8 are models showing processes of a color copying operation according to the present invention.

Figure 5:
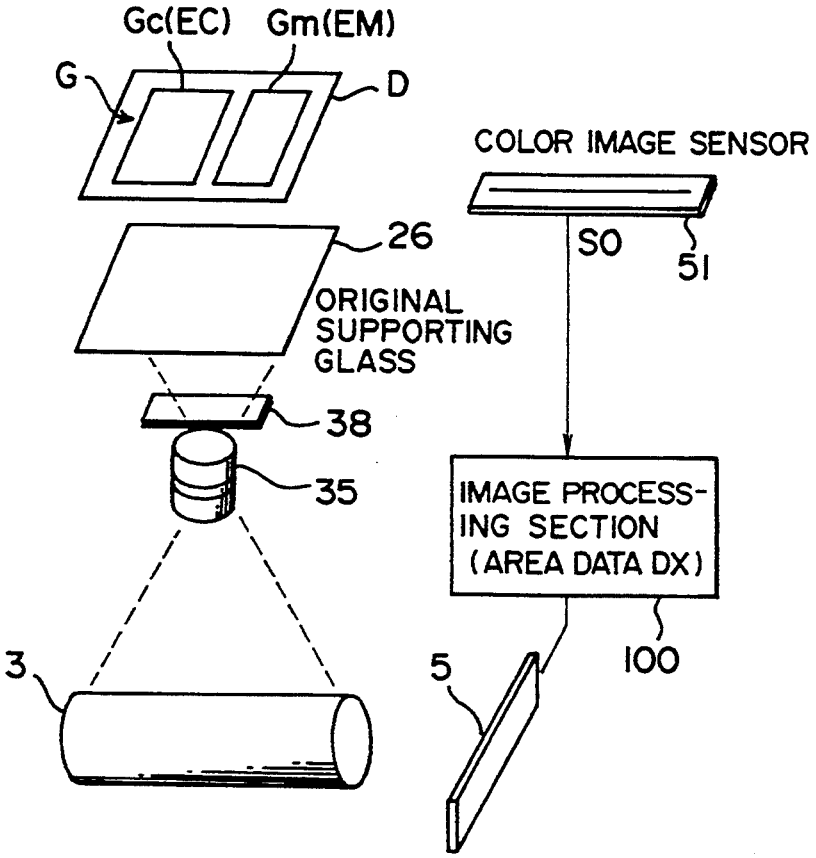
Figure 6:
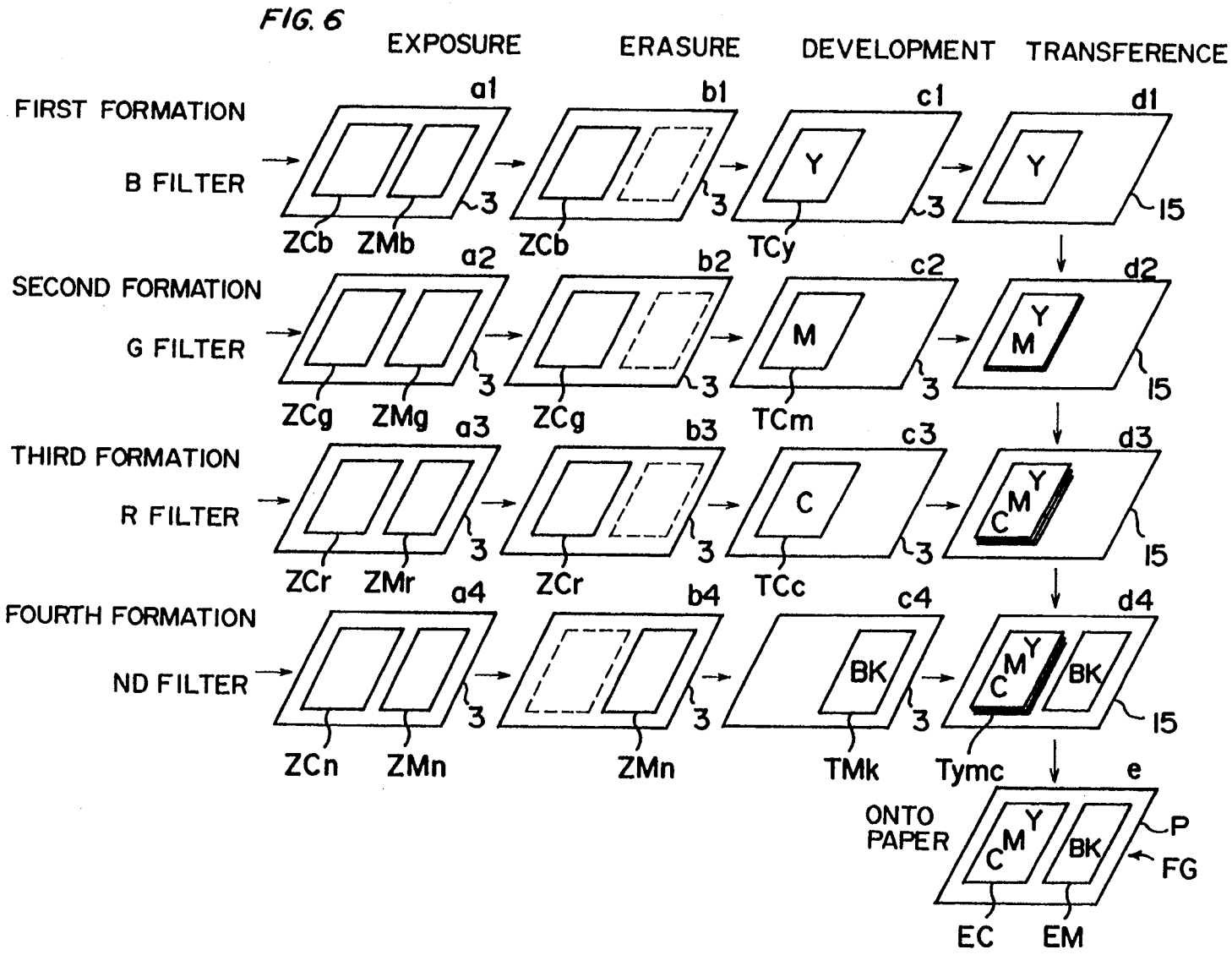
Figure 7A:
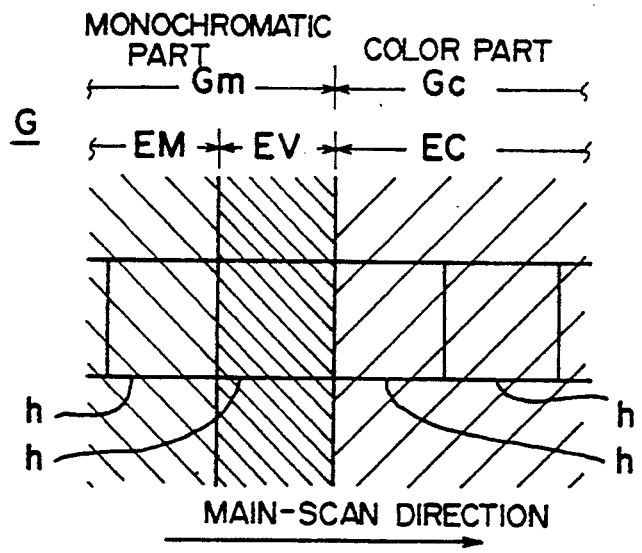
Figure 7B:
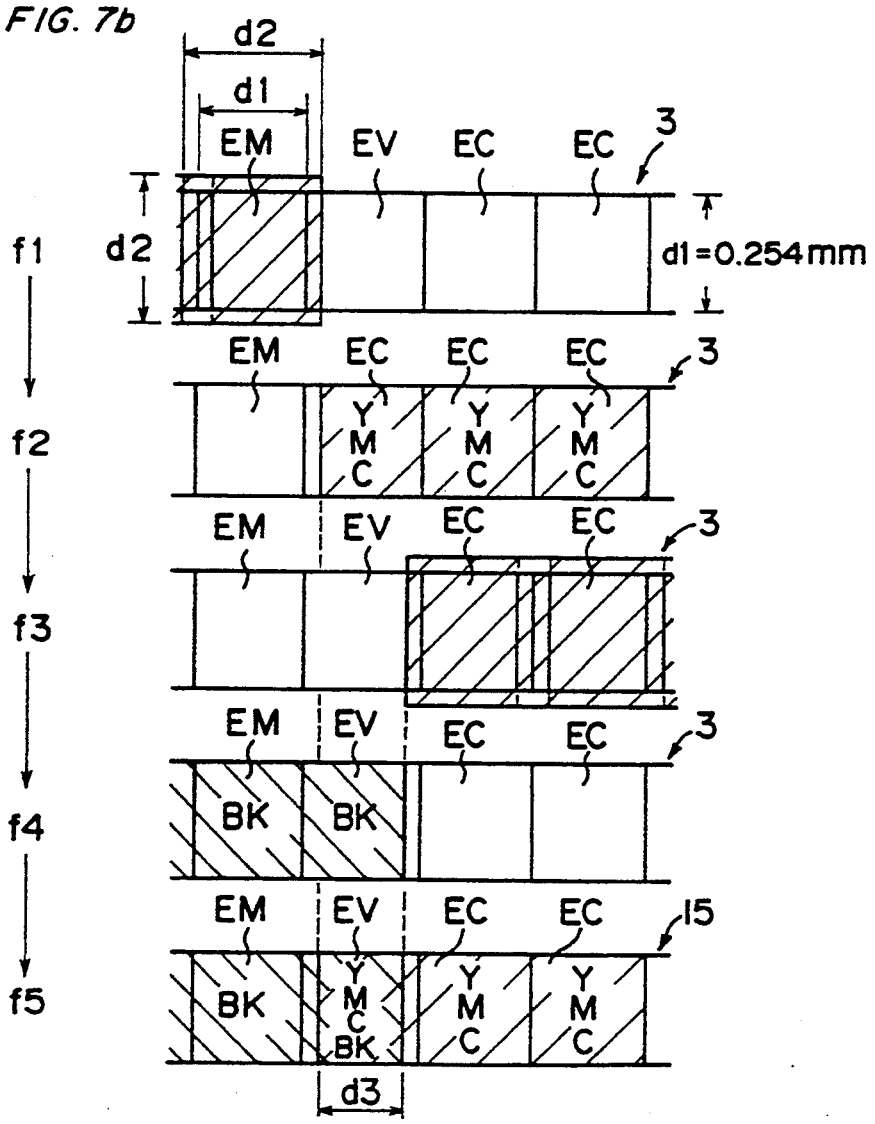

Referring to FIGS. 5 and 6, the original document D is a print on a field of white, and the image G of the original document D consists of a color part Gc such as a color picture, and a monochromatic part Gm such as letters in black.

The original document D is placed on the original supporting glass 26 with the image G facing down. When the print key 300 is pressed, a preliminary scan wherein the color image sensor 51 reads the image G is started.

Output signals SO of the color image sensor 51 are sent to the image processing section 100. In the image processing section 100, the image G is resolved into color areas EC and monochromatic areas EM, and the analysis is stored as area data DX.

FIG. 5 shows an example where the whole color part Gc of the original image G is judged to be a color area EC and the whole monochromatic part Gm is judged to be a monochromatic area EM.

After the preliminary scan, the color copying of the original document D comes to a first image formation process. For the first image formation, the Y developing device 7 and the B filter of the filter section 38 are selected and set.

The surface potential of the photosensitive drum 3, which was evenly charged by the electric charger 4, is partly reduced as the photosensitive drum 3 is exposed to a light which is reflected from the original document D and transmits the B filter. Thus electrostatic latent images ZCb and ZMb which correspond to the color part Gc (color area EC) and the monochromatic part Gm (monochromatic area EM) respectively are formed on the photosensitive drum 3 (see step al in FIG. 6).

Concurrently with the formation of the electrostatic latent images ZCb and ZMb, the image ZMb is erased by the edit eraser 5 which is controlled based on the data obtained in the preliminary scan (see step b1). The remaining latent image ZCb is developed into a yellow toner image TCy (see step c1). The toner image TCy is transferred onto the transfer belt 15 (see step d1).

Next is a second image formation process using the M developing device 8 and the G filter. As the photosensitive drum 3 is exposed to a light transmitting the G filter, electrostatic latent images ZCg and ZMg are formed (see step b1), and concurrently the latent image ZMg corresponding to the monochromatic area EM is erased by the edit eraser 5 (see step b2). The latent image ZCg is developed into a magenta toner image TCm (see step c2), and the toner image TCm is transferred onto the transfer belt 15 so that the magenta toner image TCm will overlie on the yellow toner image TCy (see step d2).

In a third image formation process, the C developing device 9 and the R filter are used. As the photosensitive drum 3 is exposed to a light transmitting the R filter, electrostatic latent images ZCr and ZMr are formed (see step a3), and concurrently the latent image ZMr corresponding to the monochromatic area EM is erased by the edit eraser 5 (see step b3). The latent image ZCr is developed into a cyan toner image TCc (see step c3), and the toner image TCc is transferred onto the transfer belt 15 so that the cyan toner image TCc will overlie on the toner images TCy and TCm (see step d3).

In a fourth image formation process, the BK developing device 10 and the ND filter are used. As the photosensitive drum 3 is exposed to a light transmitting the ND filter, electrostatic latent images ZCn and ZMn which correspond to the color area EC and the monochromatic area EM respectively are formed (see step a4). In this process, the latent image ZCn corresponding to the color part EC, not the latent image ZMn corresponding to the monochromatic area EM, is erased by the edit eraser 5 (see step b4). The remaining latent image ZMn is developed into a black toner image TMk (see step c4). The toner image TMk is transferred onto the transfer belt 15 at a specified place (see step d4).

Then, the multicolored toner image Tymc and the black toner image TMk which were formed on the transfer belt 15 in the four image formation processes are transferred onto the sheet P and fused thereon. Thus a copy FG of the original image G is formed on the sheet P (see step e).

As described above, in the first, second and third image formation processes, only the color part Gc of the original image G is copied. The color part Gc judged to be a color area EC is copied in color by combining toner of the three primary colors, and the monochromatic part Gm judged to be a monochromatic area EM is copied with toner of a single color (black).

Suppose that in the color part Gc there is a black area (black dot) which is about 1 mm square large. In a conventional color copying machine, this black dot is not copied with toner of the three primary colors but with black toner. However, in the copying machine 1 of the present invention, this black dot is copied with toner of the three primary colors. Therefore uncoloring of the periphery of the black dot on the copy image which may caused by the overlapping of irradiation units hi is prevented, and the copy image is natural.

The color copying operation of the copying machine 1 is hereinafter described in more detail referring to FIGS. *7a* and *7b*.

During the preliminary scan, the portion of the monochromatic part Gm bordering the color imaged part Gc is judged to be a border area EV, and the other portion of the monochromatic part Gm is judged to be a monochromatic area EM. The border area EV is not subjected to erasure by the edit eraser 5 in either of the four image formation processes. The color part Gc is judged to be a color area EC.

The color copying operation is hereinafter described in the light of a row of erasure units h in the main-scan direction, which includes a monochromatic area EM, a border area EV and a color area EC.

As described above, in the first, second and third image formation processes, the monochromatic area EM is subjected to erasure by the edit eraser 5 (see step f1 in FIG. *7b*). At that time, since an irradiation unit hi which is irradiated by a single LED of the edit eraser 5 is larger than an erasure unit h, the area indicated by the oblique lines in step f1 in FIG. *7b* including a part of the border area EV is irradiated by the edit eraser 5, and the latent image on the area is erased.

In the first, second and third image formation processes, the color area EC and the most part of the border area EV are not irradiated by the edit eraser 5, and the latent image on the areas remain. Accordingly the latent image is developed into a yellow toner image, a magenta toner image and a cyan toner image, and the toner images are transferred onto the transfer belt 15 in the first, second and third image formation processes (see step f2).

In the fourth image formation process, the color area EC is subjected to erasure. Actually, however, the area indicated by the oblique lines in step f3 in FIG. *7b* including a part of the border area EV is irradiated by the edit eraser 5, and the latent image on the area is erased. The monochromatic area EM and the most part of the border area EV are not irradiated by the edit eraser 5, and the latent image on the area remain. Accordingly the latent image is developed into a black toner image (see step f4).

The black toner image is transferred onto the transfer belt 15 which has received the yellow, magenta and cyan toner images (see f5).

As a result, the yellow, magenta, cyan toner images and the black toner image overlap on the transfer belt 15 at the part corresponding to the center part of the border area EV, whose width is d3.

This procedure is to ascertain the reproduction of a black portion of the monochromatic part Gm bordering the color part Gc in spite of the overlapping of irradiation units hi. Therefore a natural copy FG on which the monochromatic part Gm and the color part Gc are reproduced with continuity can be obtained.

In the copying machine 1, the color area EC and the monochromatic area EM are judged, using an area judgment matrix J which is 1.27 mm by 1.27 mm.

A monochromatic (black or white) part of the color part Gc of the original image G, such as hair (black part) of a portrait, and cloud and snow (white part) of a landscape, may be judged as a color area EC by the eye. However, if the black or white part is larger than the area judgment matrix J, the part is judged as a monochromatic area EM and is subjected to the development using black toner.

In such a case, as shown in FIG. 8, the periphery of the monochromatic area EM bordering the color area EC is judged to be a border area EV and is subjected to the development using toner of the four colors. Therefore the continuity of the image is not lost, and the image of the obtained copy FG is natural.

FIG. 9 shows the constitution of the image processing section 100 schematically. FIG. 10 shows the relationship between image elements g and erasure units h. FIG. 11 shows the area judgment matrix J.

Referring to FIG. 9, the output signals SO of the color image sensor 51 are entered in an A/D conversion section 101.

In the A/D conversion section 101, the signals SO are amplified to a specified level and quantized, and the quantized signals are converted into image data of 6 bits (64 gradations).

A shading adjustment section 102 adjusts the shading of the image data to the light distribution of the exposure lamp 29 and the sensitivity of each image element of the color image sensor 51.

The image data adjusted in the shading adjustment section 102 are sent to a sub-scan direction position adjustment section 103 (hereinafter referred as position adjustment section). The position adjustment section 103 is to time outputting R data, G data and B data about the same image element.

A color judgment section 104 judges the color and density of each image element from the R, G and B data, and makes color data dc and density data dn.

A pitch conversion section 105 makes color data DC and density data DN about an erasure unit h from the data dc and dn about four image elements g forming the erasure unit h.

An area judgment section 106 judges whether an erasure unit h in the center of the area judgment matrix J (which erasure unit is hereinafter referred as focused erasure unit X) is a color area EC or a monochromatic area EM (including a border area EV). The area judgment matrix J covers 25 erasure units h (five by five) at a time, and the judgment on the focused erasure unit X is made, based on the color data DC and the density data DN about all the 25 erasure units h. The result of the judgment is outputted as first area data DJ.

A border conversion section 107 judges from the first area data DJ whether the focused unit X is a border area EV between a color area EC and a monochromatic area EM, and outputs final area data DX.

In the area judgment section 106 and the border conversion section 107, all erasure units h are focused one after another, and every erasure unit h is labeled a color area EC, a monochromatic area EM or a border area EC.

In a memory 108, the final area data DX indicating each erasure unit h to be a color area EC, a monchromatic area EM or a border area EV are entered.

An erasure control section 109 controls the lighting and extinguishing of each LED 65 of the edit eraser 5 in accordance with the final area data DX during the four image formation processes. The latent images ZMb, ZMg and ZMr on an erasure unit h whose area data DX indicates a monochromatic area EM are erased, and the latent image ZCn on an erasure unit h whose area data DX indicates a color area EC is erased. However, no latent images on an erasure unit h whose area data DX indicates a border area EV are erased. Accordingly the latent images on the border area EV will be developed with toner of the four colors, yellow, magenta, cyan and black.

FIGS. 12*a* through 12*e* show a control circuit of the image processing section 100.

The A/D conversion section 101 comprises amplifiers 111 through 113 for amplifying the output signals SO of the color image sensor 51 regarding the three colors, red, green and blue, and A/D converters 114 through 116 for converting the outputs of the amplifiers 11 through 113 from analog signals into digital signals.

The shading adjustment section 102 comprises a selector 121 for selecting R data, G data or B data from the data sent from the A/D converters 114 through 116, a shading adjustment RAM 122 for storing R, G and B data about a line of a standard (white) image, an address section 123 for addressing the RAM 122, a buffer 124, and a shading adjustment ROM 125 having a conversion table. During the preliminary scan, data about the original document D are entered into the ROM 125 together with the data sent from the RAM 122 and adjusted in the ROM 125.

The position adjustment section 103 comprises a latch circuit 130 for latching R, G and B data about a line which are entered in order, a line memory 131 for delaying outputting the G data by a time of scanning one line, and line memories 132 and 133 for delaying outputting the R data by a time of scanning two lines.

The color judgment section 104 comprises a color judgment ROM having a conversion table, and the color judgment ROM outputs color data dc and density data dn about each image element, judging from the relationship among the R, G and B data and their absolute values.

When the values of R, G and B data are almost equal and their absolute values are small, the color judgment ROM outputs data dck indicating black. When the values of R, G and B data are almost equal and their absolute values are large, the color judgment ROM outputs data dcw indicating white. When the values of R, G and B data are different, the color judgment ROM outputs data dcf indicating other colors such as red and yellow.

The pitch conversion section 105 comprises a buffer 141, a line memory 142, an address section 143, a selector 144 for classifying color data dc about four image elements g forming an erasure unit h, which four image elements g are on two adjacent main-scan lines, into black data dck, white data dcw and color data dcf, decoder 145, a data counter 146, a pitch conversion ROM 147 for operating and outputting color data DC about the erasure unit h by referring to a conversion table with the count values of the three kinds of color data dc, a latch circuit 149 for making density data DN indicating an average density of the four image elements g from the density data dn about the four image elements g, an adder 150, a multiplier 151, and latch circuits 148 and 152 for synchronizing outputting of the color data DC and outputting of the density data DN with each other.

The area judgment section 106 comprises a data counter 165 and an adder 166 for treating color data DC about 25 erasure units h on the area judgment matrix J, adders 166 and 168 for treating density data DN about the 25 erasure units h, an area judgment ROM 169 for outputting first area data DJ by referring to a conversion table with the outputs of the adders 166 and 168, line memories 161 through 164, and latch circuits 170 through 179. The line memories 161 through 164 are to send the color data DC and density data DN about the 25 erasure units h to the data counter 165 and the adder 167 piece by piece about each row of erasure units h in the sub-scan direction. The latch circuits 170 through 177 are to send the color data DC and density data DN about the row of erasure units h to the adders 166 and 168 piece by piece about each erasure unit h. The latch circuits 178 and 179 are to synchronize the output of the adder 166 with the output of the adder 168 in sending the outputs to the ROM 169.

The border conversion section 107 comprises latch circuits 181 and 182, and a border conversion ROM 183 for outputting final area data DX. In order to make final area data DX about a focused erasure unit X, the border conversion section 107 uses first area data DJ about three erasure units h including erasure units h at both sides of the focused erasure unit X in respect to the main-scan direction. The latches 181 and 182 are to send the first area data DJ about the three erasure units h to the ROM 183 piece by piece. In the preliminary scan, final area data DX about the whole image of the original document D are stored in a memory 108 through a buffer 184.

The erasure control section 109 comprises a CPU 201 and an erase controller 202 for driving the LEDs 65 of the edit eraser 5.

The following describes a control procedure of the image processing section 100, referring to FIGS. 13, 14 and 15.

FIG. 13 shows the pitch conversion processing performed by the pitch conversion section 105.

First, color data dc and density data dn about four image elements g forming an erasure unit h are sorted out at step #21.

The color data dc and the density data dn are discriminated from each other at step #22. The average density of the erasure unit h is operated from the four pieces of density data dn at step #23, and thus the density data DN about the erasure unit h are made. It is judged at step #24 whether all the four pieces of color data dc are white data dcw. When the result of the step #24 is "YES", white data DCw are outputted as color data DC about the erasure unit h at step #25.

When the result of step #24 is "NO", it is judged at step #26 whether all the pieces of color data dc which were not judged to be white data dcw at step #24 are black data dck. When the result of the step #26 is "YES", black data DCk are outputted as color data DC about the erasure unit h at step #27. When the result of the step #26 is "NO", color data DCf indicating colors other than white and black are outputted as color data DC about the erasure unit h at step #28.

FIG. 14 shows area judgment processing performed by the area judgment section 106.

In this processing, color data DC and density data DN about 25 erasure units h on the area judgment matrix J are used to judge a focused erasure unit X in the center of the matrix J.

At step #31, the 25 pieces of color data DC are classified into white data DCw, black data DCk and color data DCf, and the values of the 25 pieces of density data DN are added up.

When all the 25 pieces of color data DC are color data DCf (situation a in FIG. 14), when the 25 pieces of color data DC include black data DCk, white data DCw and color data DCf (situation b), and when all the 25 pieces of color data DC are white data DCw (situation c), the processing goes to step #33 where the focused erasure unit X is judged as a color area EC.

When all the 25 pieces of color data DC are white data DCw, the focused erasure unit X is judged as a color area EC, and the erasure unit X is not subjected to erasure by the edit eraser 5 during the first, second and third image formation processes as described referring to FIGS. 5 through 8. Therefore even when the color judgment section 104 has misjudged a light color to be white, the light color can be reproduced with toner of yellow, magenta and cyan in the first, second and third image formation processes.

When all the 25 pieces of color data DC are black data DCk (situation d in FIG. 14), the total value of the 25 pieces of density data DN is compared with a specified value at step #32 so as to judge whether the color of the area covered by the area judgment matrix J is light or dark as a whole. When the total value of the density data DN is smaller than the specified value, which means that the color of the area is light, the focused erasure unit X is judged as a color area EC at step #32. When the total value of the density data DN is not smaller than the specified value, the focused erasure unit X is judged as a monochromatic area EM at step #34.

Thus, area judgment on the focused erasure unit X can be made more accurately by using the density data DN effectively in the area judgment processing (steps #32, #33 and #34). For example, grayish black (light black), which is in most cases in a color part Gc but is judged to be black by the color judgment section 104, is rejudged as a color area EC in this processing. Then, the grayish black part is reproduced with toner of yellow, magenta and cyan more naturally than with black toner. However, true black is in most cases in a monochromatic part Gm such as letters and drawings, and it is preferred that the true black image is reproduced with black toner.

When the 25 pieces of color data DC are composed of black data DCk and white data DCw (situation e in FIG. 14), the area covered by the area judgment matrix J is judged to correspond to a monochromatic part Gm such as black letters and drawings on a field of white, and the focused erasure unit X is judged as a monochromatic area EM.

FIG. 15 shows a border judgment processing performed by the border conversion section 106.

At step #41, erasure units h at both sides of the focused erasure unit X in respect to the main-scan direction are designated as neighboring erasure units W.

The judgment of the area judgment section 106 on the focused erasure unit X is checked at step #42. When the area judgment section 106 has judged the focused erasure unit X as a color area EC, ("NO" at step #42), the focused erasure unit X remains a color area EC. When the area judgment section 106 has judged the focused erasure unit X as a monochromatic area EM ("YES" at step #42), the processing goes to step #43 so as to check the two neighboring erasure units W. When neither of the neighboring erasure units W is a color area EC ("NO" at step #43), the focused erasure unit X remains a monochromatic area EM. When at least one of the neighboring erasure units W is a color area EC ("YES" at step #43), the processing goes to step #44 where the focused erasure unit X is rejudged as a border area EV.

Figure 12A:
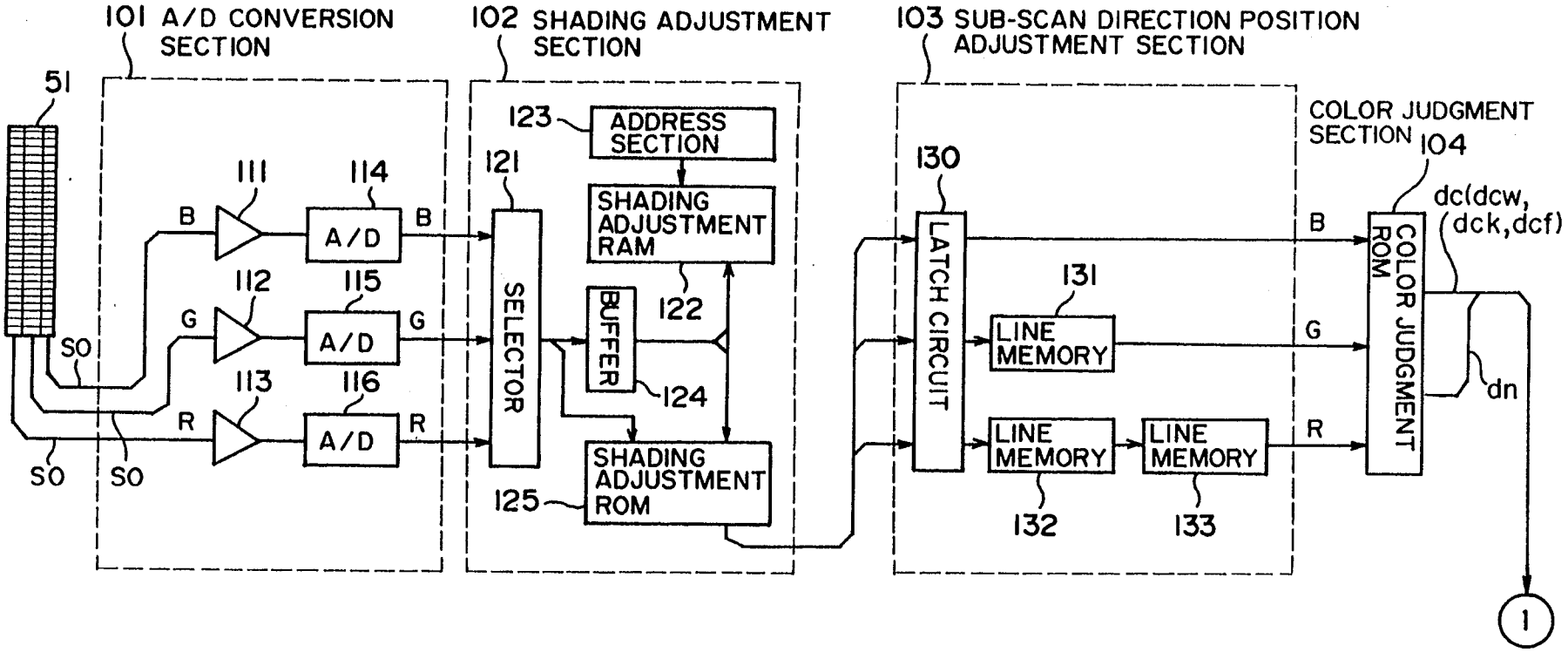
Figure 12B:
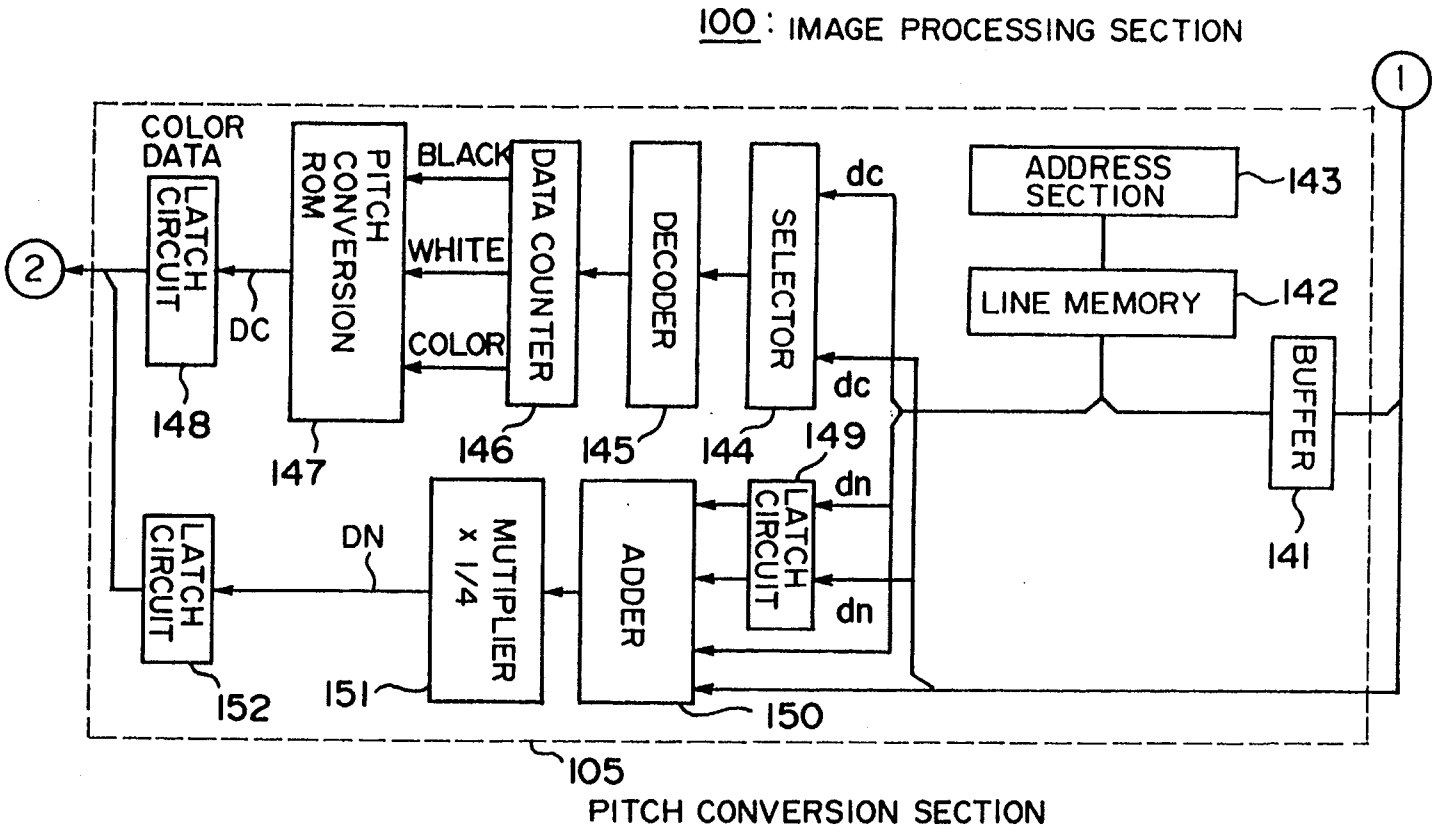
Figure 12C:
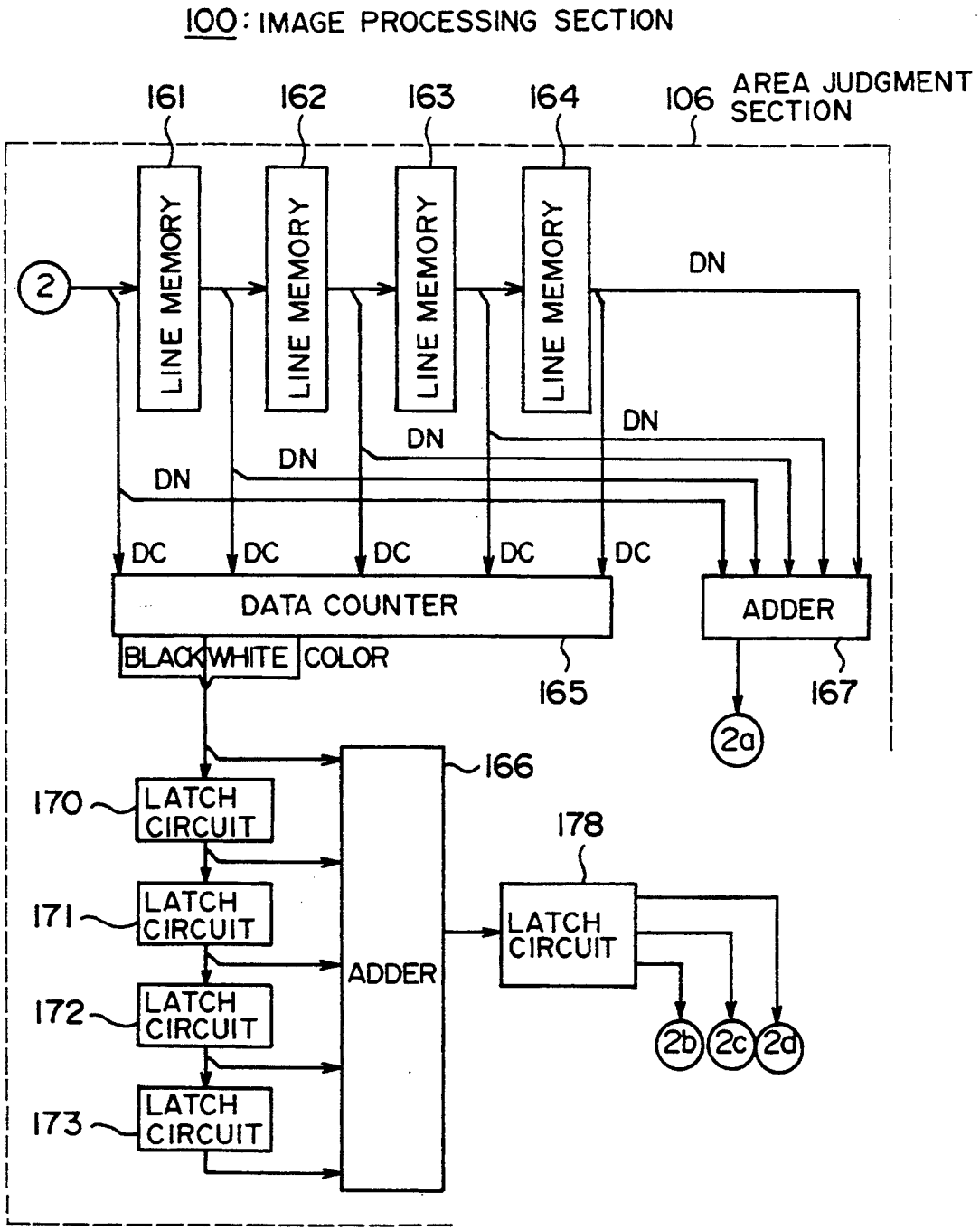
Figure 12D:
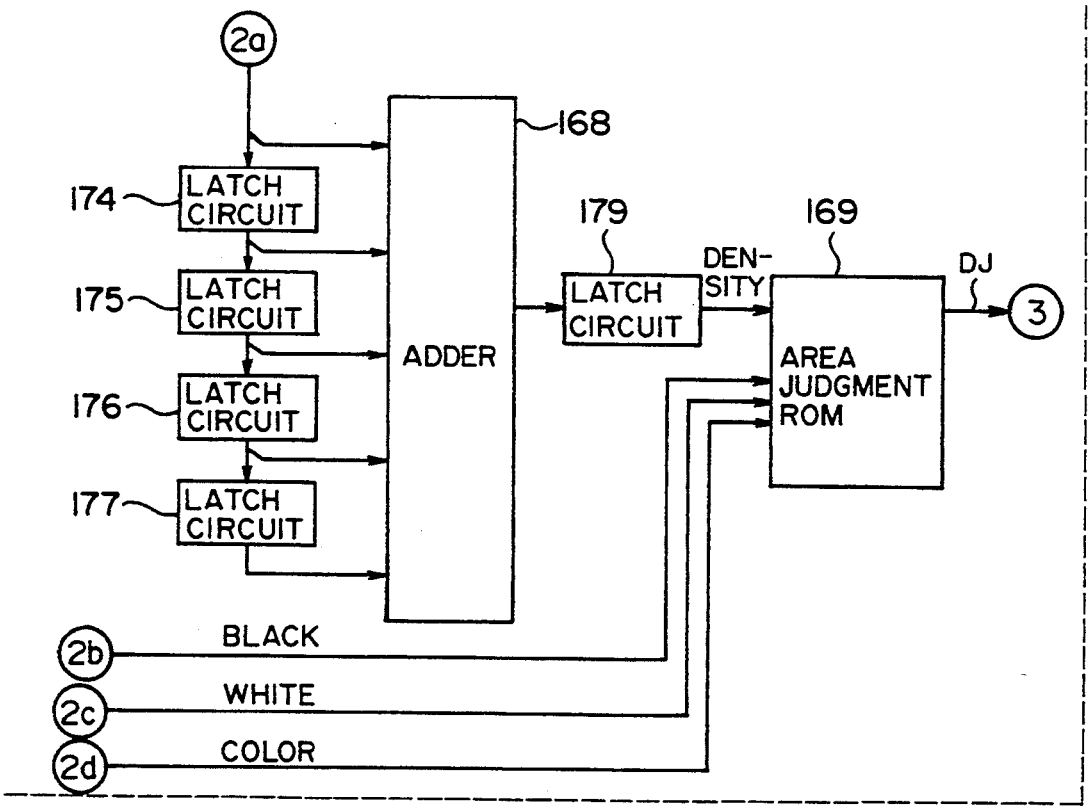
Figure 12E:
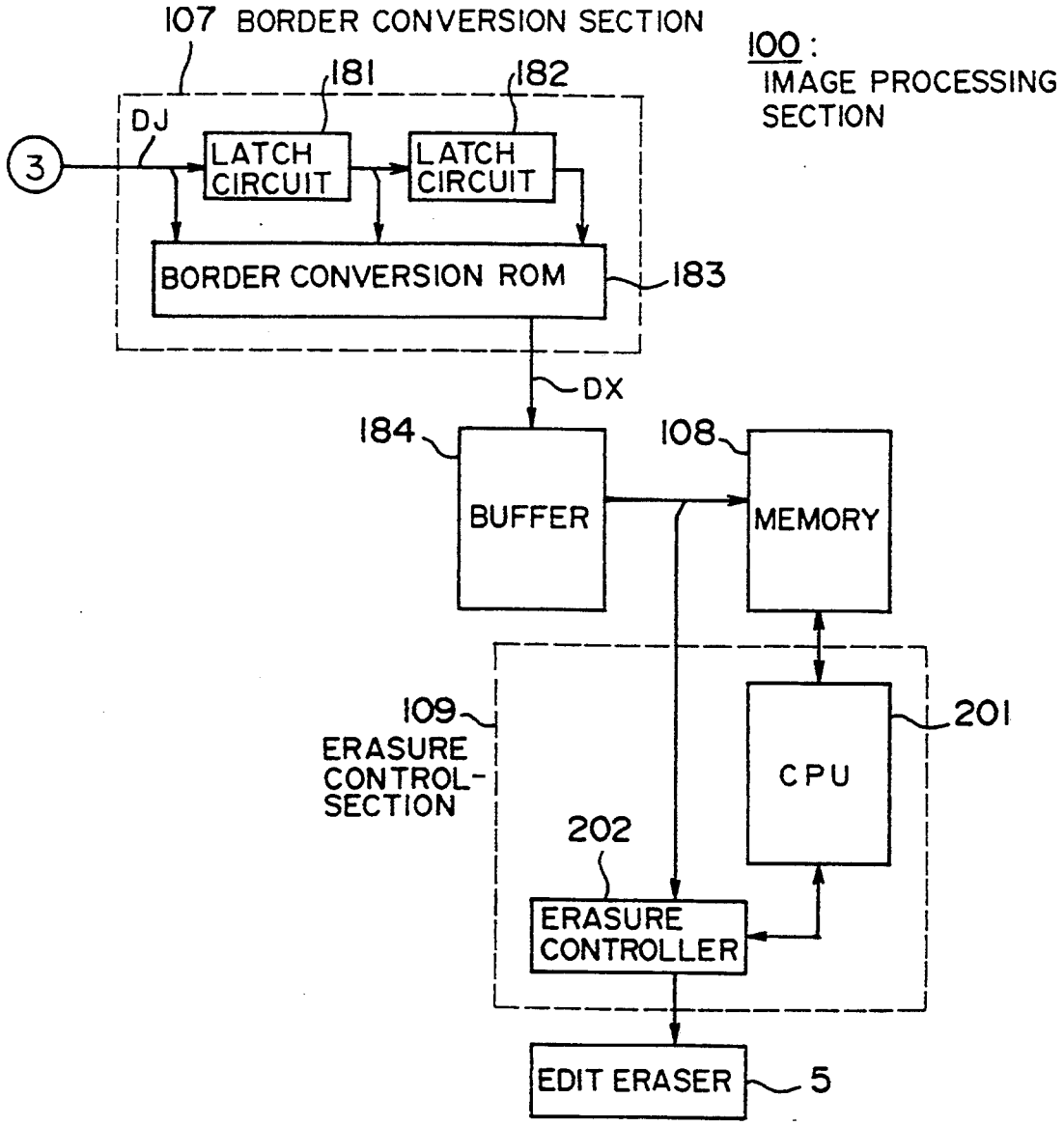
Figure 16A:
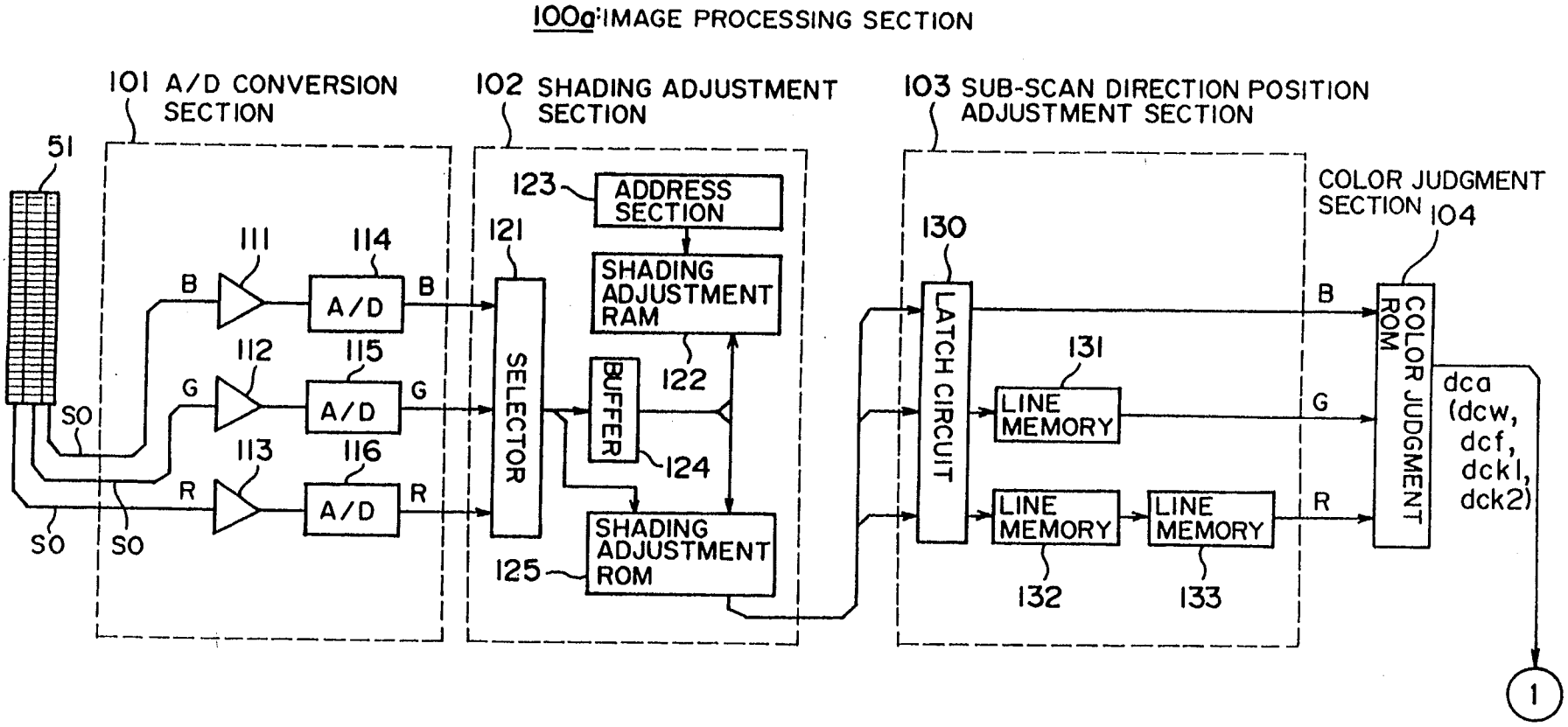
Figure 16B:
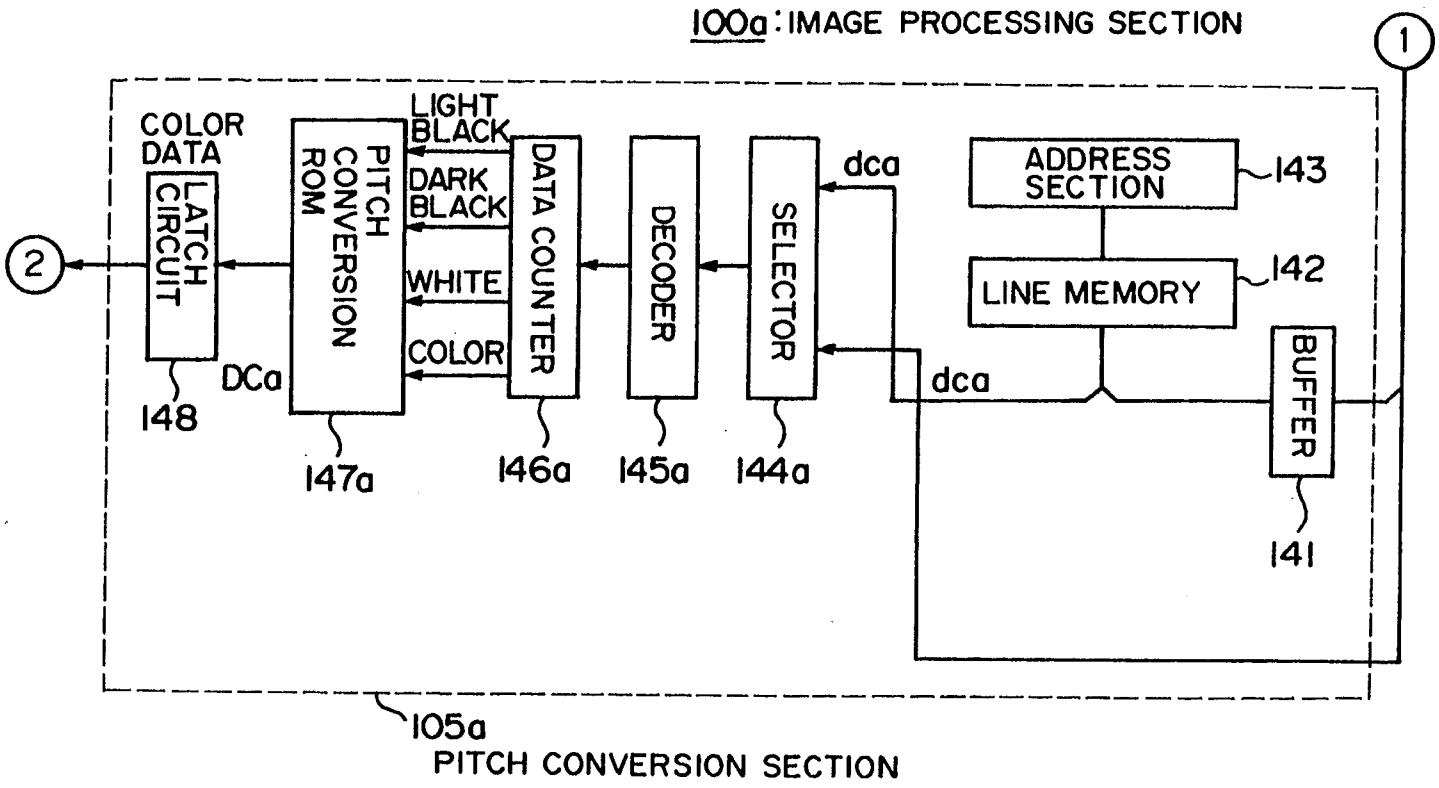
Figure 16C:
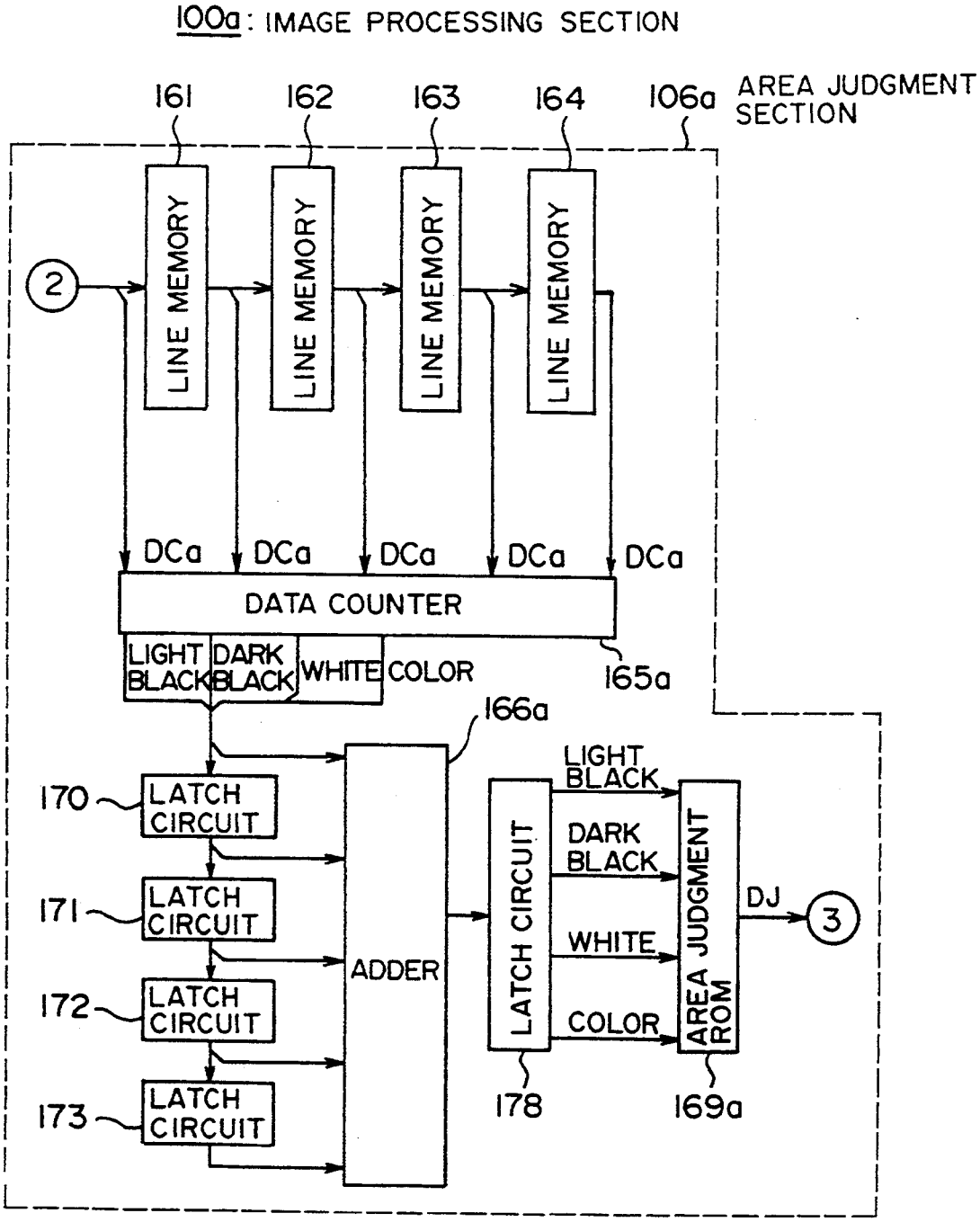
Figure 16D:
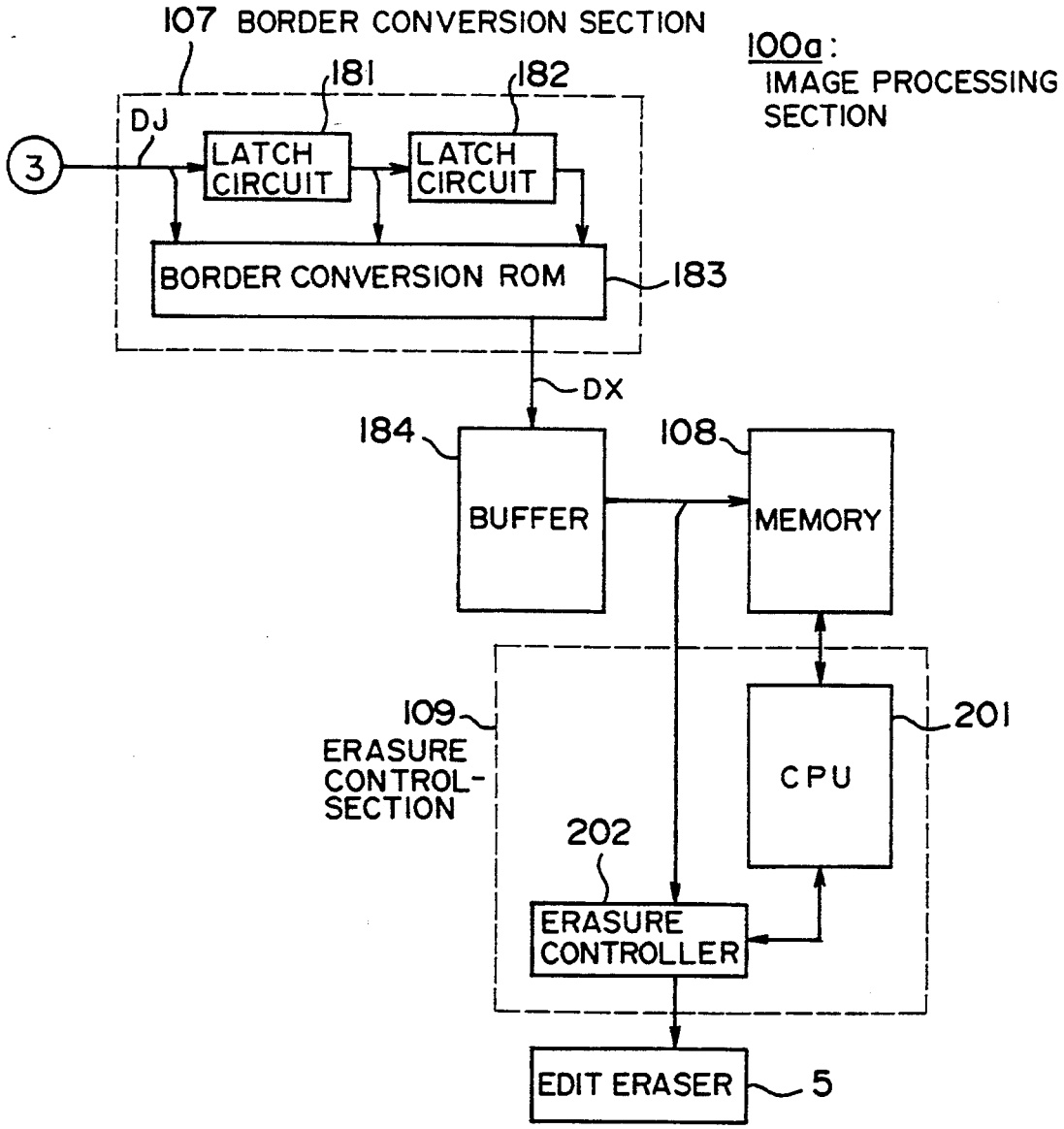

FIGS. 16*a* through 16*d* show an image processing section 100*a* of a second embodiment of the present invention. In FIGS. 16*a* through 16*d*, the components which were already indicated in FIGS. 12*a* through 12*e* are numbered the same, and description of these components is omitted. The area judgment section 106 of the first embodiment is shown in FIGS. 12*c* and 12*d*, but an area judgment section 106*a* of the second embodiment is shown in FIG. 16*c*.

A color judgment section 104*a* of this image processing section 100*a* comprises a color judgment ROM having a conversion table, and the color judgment ROM outputs color data dca about each image element g, judging from the relationship among the R, G and B data and their absolute values. FIG. 20 shows the relationship between the R, G and B data, and color data dca outputted from the color judgment ROM. When the values of R, G and B are almost equal and their absolute values are larger than a first threshold value Vth1, the color judgment ROM outputs color data dcw indicating white. When the values of the R, G and B data are almost equal and their absolute values are between the first threshold value Vth1 and a second threshold value Vth2 (Vth1<Vth2), the color judgment ROM outputs color data dck1 indicating light black. When the values of the R, G and B data are almost equal and their absolute values are smaller than the second threshold value Vth2, the color judgment ROM outputs color data dck2 indicating dark black. When the values of the R, G and B data are different, the color judgment ROM outputs color data dcf indicating other colors such as red and yellow.

A pitch conversion section 105*a* of the image processing section 100*a* comprises a buffer 141, a line memory 142, an address section 143, a selector 144*a* for classifying color data dca about four image elements g forming an erasure unit h, which image elements g are on two adjacent main-scan lines, into light black data dck1, dark black data dck2, white data dcw and color data dcf, a decoder 145a, a data counter 146a, and a pitch conversion ROM 147a for operating and outputting color data DCa by referring to a conversion table with count values of the four kinds of color data dca. Thus, color data DCa about the erasure unit h are made from the color data dca about the four image elements g forming the erasure unit h.

The area judgment section 106a of the image processing section 100a comprises a data counter 165a and an adder 166a for treating color data DCa about 25 erasure units h on the area judgment matrix J, an area judgment ROM 169a for outputting first area data DJ about a focused erasure unit X in the center of the area judgment matrix J by referring to a conversion table with the output of the adder 166a. Thus, the area judgment section 106a judges the focused erasure unit X whether to be a color area EC or a monochromatic area EM, from the color data DCa.

The first area data DJ are sent from the color judgment section 106a to the border judgment section 107. As described in connection with the first embodiment, final area data DX are made from the first area data DJ, and the edit eraser 5 is controlled in accordance with the final area data DX sent from the border judgment section 107.

The following describes a control procedure of the image processing section 100a, referring to FIGS. 17, 18 and 19.

First, color data dca about four image elements g forming an erasure unit h are sorted out at step #51.

It is judged at step #52 whether the color data dca are all white data dcw. When the result of the step #52 is "YES", white data DCw is outputted as color data DCa about the erasure unit h. When the result of the step #52 is "NO", the processing goes to step #54 where it is judged whether the color data dca are all light black data dck1. When the result of the step #54 is "YES", light black data DCk1 is outputted as color data DCa at step #55.

When the result of the step #54 is "NO", it is judged at step #56 whether the color data dca are all dark black data dck2. When the result of the step #56 is "YES", dark black data DCk2 is outputted as color data DCa at step #57.

When the result of the step #56 is "NO", it is judged at step #58 whether the color data dca are all color data dcf. When the result of the step #58 is "YES", color data DCf is outputted as color data DCa at step #59.

When the result of the step #58 is "NO", it is judged at step #60 which kind of data is the majority among the four pieces of color data dca. At this step #60, white data dcw are not counted.

When light black data dck1 are judged to be the majority at step #60, the processing goes to step #55, and when dark black data dck2 are judged to be the majority, the processing goes to step #57. When color data dcf are judged to be the majority, the processing goes to step #59.

FIG. 18 shows area judging processing performed by the area judgment section 106a.

In this processing, 25 pieces of color data DCa about 25 erasure units h on the area judgment matrix J are used to judge a focused erasure unit X in the center of the matrix J.

First, the 25 pieces of color data DCa are checked at step #71. When the color data DCa are all white data DCw (situation f in FIG. 18), when the color data DCa are all light black data DCk1 (situation g), and when the color data DCa are all color data DCf (situation h), the processing goes to step #73 where the focused erasure unit X is judged as a color area EC.

When the color data DCa are composed of at least either light black data DCk1 or dark black data DCk2, and color data DCf (situation i), the total amount of light black data DCk1 and dark black data DCk2 is compared with the amount of color data DCf at step #72.

When the total amount of light black data DCk1 and dark black data DCk2 is smaller than the amount of color data DCf ("NO" at step #72), the focused erasure unit X is judged as a color area EC at step #73.

When the total amount of light black data DCk1 and dark black data DCk2 is not smaller than the amount of color data DCf ("YES" at step #72), the focused erasure unit X is judged as a monochromatic area EM at step #74.

When the color data DCa are composed of at least either light black data DCk1 or dark black data DCk2, and white data DCw (situation j), and when the color data DCa are all dark black data DCk2 (situation k), the focused erasure unit X is judged as a monochromatic area EM at step #74.

FIG. 19 shows a modification of the area judgment processing performed by the area judgment section 106a.

First, 25 pieces of color data DCa about 25 erasure units h on the area judgment matrix J are checked at step #81. According to the result, area judgment on a focused erasure unit X in the center of the area judgment matrix J is made.

When the color data DCa are all white data DCw (situation 1 in FIG. 19), when the color data DCa are all light black data DCk1 (situation m), when the color data DCa are all color data DCf (situation n), when the color data DCa are composed of light black data DCk1 and color data DCf (situation o), and when the color data DCa are composed of light black data DCk1 and white data DCw (situation p), the processing goes to step #83 where the focused erasure unit X is judged as a color area EC.

When the color data DCa are composed of at least either light black data DCk1 or dark black data DCk2, and color data DCf (situation q), the processing goes to step #82 where the amount of dark black data DCk2 is compared with the total amount of light black data DCk1 and color data DCf.

When the amount of dark black data DCk2 is smaller than the total amount of light black data DCk1 and color data DCf ("NO" at step #82), the focused erasure unit X is judged as a color area EC at step #83. When the amount of dark black data DCk2 is not smaller than the total amount of light black data DCk1 and color data DCf ("YES" at step #82), the focused erasure unit X is judged as a monochromatic area EM at step #84.

When the color data DCa are composed of dark black data DCk2 and white data DCw (situation r), and when the color data DCa are all dark black data DCk2 (situation s), the focused erasure unit X is judged as a monochromatic area EM at step #84.

In the embodiments above, when there is a black portion (black dot) which is 1 mm square large in a color part Gc of an original image G, the black dot is reproduced with toner of the three primary colors as the rest of the color part Gc is. If the black dot is reproduced with black toner and the rest of the color part Gc is reproduced with toner of the three primary colors, the periphery of the black dot may not be reproduced because of the overlapping of irradiation units hi. However, in the embodiments, such trouble does not occur, and a natural copy image can be obtained.

Also, a border between a monochromatic part Gm and a color part Gc is judged as a border area EV, and the border area EV is reproduced with toner of the four colors. Therefore in spite of the overlapping of irradiation units hi, the border between the monochromatic part Gm and the color part Gc can be reproduced, and the thus obtained copy image has continuity and is natural.

A focused erasure unit X which was judged as a monochromatic area EM by the area judgment section 106 or 106*a* is further judged by the border judgment section 107 whether it is a border area EV bordering a color area EC. What is judged as a border area EV which will be reproduced with toner of the four colors is a portion of a monochromatic part Gm, not a color part Gc. Accordingly, black toner never sticks to any color areas, and color reproductivity is assured.

In the first embodiment, when the color data DC about 25 erasure units h on the area judgment matrix J are all black data DCk, the density of the whole area covered by the matrix J is judged from density data DN about the 25 erasure units h. Therefore the area judgment on the focused erasure unit X becomes more accurate.

Generally, light black (grayish black) is used in a color part Gc, for example, as a field, and dark black is used in a monochromatic part Gm, for example, as letters and drawings. Checking both the color and density of an area leads to more accurate judgment whether it is in a monochromatic part Gm or in a color part Gc than checking only the color.

In the second embodiment, the color judgment ROM classifies black into light black and dark black in accordance with the density, and the color judgment ROM outputs four kinds of color data, light black data dck1, dark black data dck2, white data dcw and color data dcf. Therefore in the following pitch conversion processing and area judgment processing, components such as adders 150, 167 and 168 for treating density data dn and DN which are provided in the image processing section 100 of the first embodiment are not required. Thus, the circuit of the image processing section 100*a* of the second embodiment is simpler than that of the first embodiment.

Although the present invention has been described in connection with the embodiments above, it is to be noted that various changes and modifications are apparent to those who are skilled in the art. Such changes and modifications are to be understood as included in the appended claims.

For example, in order to judge whether a focused erasure unit X is a border area EV, in the embodiments above, erasure units h at both sides of the focused erasure unit X in respect to the main-scan direction are examined. However, it is possible to examine erasure units h at both sides of the focused erasure unit X in respect to the sub-scan direction, or to examine erasure units h at both sides of the focused erasure unit X in respect to both the main-scan direction and the sub-scan direction.

The area judgment matrix J is not limited to that described in the embodiments and can be of any proper size and shape.

The present invention can be adapted to a digital color printer as well as an analog copying machine, and can be adopted to a heat transfer type printer and ink-jetted type printer as well as an electrophotographic machine.

What is claimed is:

1. An image forming apparatus for forming a multi-colored image, said image forming apparatus comprising:

an image forming device which is capable of forming images in different colors, said image forming device including first image formation means for forming an image in a specified color other than white and a plurality of second image formation means for forming an image in different colors including the specified color, said image forming device being capable of forming an image in the specified color by using said first image formation means without using said plurality of second image formation means, said image forming device being capable of forming an image in the specified color by using said plurality of second image formation means without using said first image formation means;

control means for driving said image forming device in accordance with image signals indicating the density and color of an image to be formed; and means for judging each part of the image whether to be a monochromatic area composed of white and the specified color or to be a color area that includes any color other than the specified color, from the image signals;

wherein the control means controls said image forming device in accordance with output of the judging means so that the specified color part of the monochromatic area is formed by only the first image formation means and that the specified color part of the color area is formed by the second image formation means.

2. An image forming apparatus as claimed in claim 1, wherein the specified color is black.

3. An image forming apparatus as claimed in claim 1, wherein the judging means judges a part of the image whether to be a monochromatic area or to be a color area, from the image signals regarding the part and its periphery.

4. An image forming apparatus as claimed in claim 1, further comprising a color image sensor for reading an original image and outputting image signals indicating the density and color of the image.

5. An image forming apparatus as claimed in claim 1, further comprising means for detecting a border area between the monochromatic area and the color area;

wherein the control means controls said image forming device so that the specified color part of the monochromatic area is formed by only the first image formation means, that the specified color part of the color area is formed by the second image formation means other than the first image formation means, and that the specified color part of the border area is formed by both the first image forming means and the second image forming means.

6. An image forming apparatus for forming a multi-colored image, comprising:

image formation means for forming images on a sheet in different colors in accordance with image signals regarding an image to be formed, said image formation means being capable of forming an image in a specified color by using a single color as well as by combining different colors;

means for recognizing the colors of the image according to the image signals; and means for judging each part of the image whether to be a monochromatic area or a color area that includes colors other than the specified color, from output of the color recognizing means;

wherein the image formation means forms a part of the monochromatic area of the specified color by using the single color and forms the specified color part of the color area by combining the different colors.

7. An image forming apparatus for forming a multicolored image, comprising:

first image formation means;

second image formation means;

control means for driving the first and the second image formation means in accordance with image signals regarding an image to be formed, the image signals including color data; and means for judging each part of the image whether to be a monochromatic area composed of white and a specified color, to be a color area including any other color or to be a border area between the monochromatic area and the color area, from the image signals;

wherein the control means controls the first and the second image formation means in accordance with output of the judging means so that the specified color part of the monochromatic area is formed by the first image formation means, that the specified color part of the color area is formed by the second image formation means, and that the specified color part of the border area is formed by both the first and the second image formation means.

8. An image forming apparatus for forming a multicolored image, comprising:

a plurality of image formation means for forming images in different colors, including first image formation means for forming an image in a specified color; and control means for driving the plurality of image formation means selectively in accordance with density data indicating the density of an image to be formed and color data indicating the color of the image;

wherein the control means controls the plurality of image formation means so that the specified color part is formed by only the first image formation means when the density data indicates that the specified color is dark, and that the specified color part is formed by a plurality of image formation means when the density data indicates that the specified color is light.

9. An image forming apparatus as claimed in claim 8, wherein the specified color is black.

10. An image forming apparatus for forming a multicolored image, comprising:

a plurality of developing means which contain developers of different colors;

means for reading an original image;

means for making color data regarding each unit of the original image from output of the image reading means;

means for judging each unit whether to be a monochromatic area or to be a color area, from the color data regarding the unit and its peripheral units in a specified size of block; and control means for controlling the plurality of developing means so that the monochromatic area is developed by only one of the developing means and that the color area is developed by more than one of the developing means.

11. An image forming apparatus as claimed in claim 10, wherein the judging means judges a unit to be a color area when all the color data regarding the units in the block indicate white.

12. An image forming apparatus for forming a multicolored image, comprising:

a plurality of developing means which contain developers of different colors;

means for reading an original image;

means for making color data and density data regarding each unit of the original image from output of the image reading means;

means for judging each unit whether to be a monochromatic area or to be a color area, from the color data and the density data regarding the unit and its peripheral units in a specified size of block; and control means for controlling the plurality of developing means so that the monochromatic area is developed by only one of the developing means and that the color area is developed by more than one of the developing means.

13. An image forming apparatus as claimed in claim 12, wherein the judging means judges a unit to be a color area when all the color data regarding the units in the block indicate black and the density data indicate that the density of the block is light.

14. An image forming apparatus for forming a multicolored image, comprising:

a plurality of developing means which contain developers of different colors;

means for reading an original image;

means for making color data regarding each unit of the original image from output of the image reading means, the color data including data indicating dark black and data indicating light black; and control means for controlling the plurality of developing means so that the dark black unit is developed by only one of the developing means and that the light black unit is developed by more than one of the developing means.

15. A copying apparatus comprising:

a photosensitive member which is rotated in one direction;

an electric charger for charging the surface of the photosensitive member;

means for projecting an original image onto the electrically charged surface of the photosensitive member so as to form an electrostatic latent image on the surface;

a plurality of filter members for cutting different colors;

means for irradiating the surface of the photosensitive member partly so as to erase the electrostatic latent image partly;

a plurality of developing means containing developers of different colors for developing the electrostatic latent image, one of the developing means containing a black developer;

means for transferring the image developed by the developing means onto a sheet;

a color image sensor for reading the original image and outputting image signals including data on the density and color of the image;

image projection control means for controlling the image projecting means to project the original image onto the surface of the photosensitive member repeatedly;

means for changing the filter members and the developing means selectively, every time the original image is projected onto the surface of the photosensitive member;

means for judging the color of each part of the original image, from the image signals sent from the color image sensor;

means for dividing the original image into a monochromatic area and a color area according to output of the color judging means;

erasure control means for controlling the erasing means to erase a part of the electrostatic latent image corresponding to a black part of the monochromatic area when the developing means other than the black developing means are to be used, and to erase parts of the electrostatic latent image corresponding to the color area and a non-black part of the monochromatic area when the black developing means is to be used.

16. A copying apparatus as claimed in claim 15, wherein the monochromatic area is composed of black and white, and the color area includes any other color.

17. A copying apparatus as claimed in claim 15, further comprising means for detecting a border area between the monochromatic area and the color area, wherein the erasure control means controls the erasing means not to erase a part of the electrostatic latent image corresponding to the border area when the black developing means is to be used and when at least one other developing means is to be used.

18. A method for forming a multicolored image by use of a color copying apparatus which comprises a photosensitive member, a plurality of developing means containing developers of different colors, a color image sensor for reading an original image and outputting image signals indicating the density and color of the image, the method comprising the steps of:

reading an original image with the color image sensor;

judging the color of each part of the original image, from output of the color image sensor;

dividing the original image into a monochromatic area and a color area in accordance with output at the color judging steep;

forming an electrostatic latent image corresponding to the original image on the photosensitive member;

erasing a part of the electrostatic latent image corresponding to a black part of the monochromatic area so as to form a first electrostatic latent image;

developing the first electrostatic latent image with developing means which contains a color developer other than black;

forming an electrostatic latent image corresponding to the original image on the photosensitive member again;

erasing parts of the electrostatic latent image corresponding to the color area and a non-black part of the monochromatic area so as to form a second electrostatic latent image; and developing the second electrostatic latent image with the developing means which contains a black developer.

19. A method for forming a multicolored image as claimed in claim 18, further comprising the step of detecting a border area between the monochromatic area and the color area, wherein at both of the electrostatic latent image erasing steps, a part corresponding to the border area is not erased.

20. A method for forming a multicolored image by using a plurality of image formation means which form images in different colors, said method comprising the steps of:

recognizing the colors of an image to be formed;

judging each part of the image whether to be a monochromatic area composed of white and a specified color or to be a color area including any other color, from output at the color recognizing step;

forming the specified color part of the monochromatic area with a specified one of the image formation means in accordance with output at the area judging step; and forming the specified color part of the color area with more than one of the image formation means by overlaying images of different colors.

21. A method for forming a multicolored image as claimed in claim 20, wherein the specified color is black.

22. A method for forming a multicolored image as claimed in claim 20, further comprising the steps of:

detecting a border area between the monochromatic area and the color area; and forming the border area with more than one of the image formation means including the specified one used to form the specified color part of the monochromatic area.

* * * * *